US011534046B2

(12) United States Patent
Jang et al.

(10) Patent No.: US 11,534,046 B2
(45) Date of Patent: Dec. 27, 2022

(54) CLEANER

(71) Applicant: LG ELECTRONICS INC., Seoul (KR)

(72) Inventors: Jaewon Jang, Seoul (KR); Minwoo Lee, Seoul (KR); Jinho Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 329 days.

(21) Appl. No.: 16/944,242

(22) Filed: Jul. 31, 2020

(65) Prior Publication Data

US 2021/0030246 A1 Feb. 4, 2021

(30) Foreign Application Priority Data

Jul. 31, 2019 (KR) ..... 10-2019-0093490

(51) Int. Cl.

| | |
|---|---|
| ***A47L 11/40*** | (2006.01) |
| ***A47L 11/24*** | (2006.01) |
| ***A47L 11/282*** | (2006.01) |

(52) U.S. Cl.

CPC ..... *A47L 11/4069* (2013.01); *A47L 11/24* (2013.01); *A47L 11/282* (2013.01); (Continued)

(58) Field of Classification Search

CPC ..... A47L 11/24; A47L 11/40; A47L 11/4069; A47L 11/282

See application file for complete search history.

(56) References Cited

U.S. PATENT DOCUMENTS 4,268,935 A * 5/1981 Bessinger ..... A47L 11/4055 15/387
2015/0143658 A1* 5/2015 Jang ..... A47L 11/4044 15/347

(Continued)

FOREIGN PATENT DOCUMENTS

JP 3072211 B2 7/2000
KR 10-0246504 5/2000

(Continued)

OTHER PUBLICATIONS

PCT International Search Report, dated Nov. 13, 2020, issued in International Application No. PCT/KR2020/010074 (5 pages).

(Continued)

*Primary Examiner* — Michael D Jennings
(74) *Attorney, Agent, or Firm* — Birch, Stewart, Kolasch & Birch, LLP

(57) ABSTRACT

A cleaner includes a body including an insertion slot facing a floor and an installation space inside the body. The cleaner includes a dust housing detachably connected to the body. The dust housing includes a collection opening surface and a storage space that stores foreign substances collected through the collection opening surface. The cleaner has an agitator rotatably connected to the dust housing and exposed through the collection opening surface. The cleaner also includes a driving apparatus that rotates a driving coupler, which drives a driven coupler coupled to the agitator. The cleaner includes a lever located on either the driving coupler or the driven coupler. The lever selectively attaches or separates the driving coupler and the driven coupler. Manipulating the lever separates the driving coupler and the driven coupler and allows the sweep module including the agitator to be removed through the insertion slot in the body.

20 Claims, 21 Drawing Sheets

(52) U.S. Cl.
CPC ..... *A47L 11/4013* (2013.01); *A47L 11/4041* (2013.01); *A47L 11/4066* (2013.01); *A47L 2201/00* (2013.01)

(56) References Cited

U.S. PATENT DOCUMENTS

| | | | | |
|---|---|---|---|---|
| 2017/0325648 | A1* | 11/2017 | Huang | A47L 9/0433 |
| 2017/0332868 | A1* | 11/2017 | Nam | A47L 9/04 |

FOREIGN PATENT DOCUMENTS

| | | |
|---|---|---|
| KR | 10-1911294 | 10/2018 |
| KR | 10-1932045 | 12/2018 |
| KR | 10-2019-0000893 | 1/2019 |

OTHER PUBLICATIONS

Korean Office Action, dated Sep. 22, 2020, issued in Korean Patent Application No. 10-2019-0093490 (6 pages).

* cited by examiner

CLEANER

TECHNICAL FIELD

The present disclosure relates to a cleaner for mopping, and more particularly, to a cleaner that allows for removing an agitator and a dust housing at one time.

BACKGROUND

A cleaner is a device that cleans a floor by sucking up foreign substances such as dust from the floor or wiping foreign substances from the floor. In recent years, cleaners for mopping have been under development. Also, a robotic cleaner is device that cleans autonomously while moving itself.

Korean Patent Registration No. 10-1602790 (hereinafter, Conventional Technology 1) discloses a robotic cleaner that moves itself while performing wet cleaning using a wet cleaner.

In the Conventional Technology 1, the robot cleaner comprises a pair of cleaners placed on the left and right, and a driving apparatus for spinning the cleaners by providing driving force.

However, the Conventional Technology 1 was problematic in that, although wet cleaning and movement can be done by the pair of cleaners, foreign substances cannot be sucked up from floors.

Korean Unexamined Patent Application No. 10-2005-0034112 (hereinafter, Conventional Technology 2) discloses a robotic cleaner equipped with a dust bin and a mop.

However, the Conventional Technology 2 has the problem of the complicated operating structure because it requires wheels and motor for moving the robotic cleaner and a suction fan and motor for sucking up dust to be provided separately.

SUMMARY

The present disclosure provides a cleaner that moves and mops by spinning a pair of mop modules, capable of cleaning up foreign substances on the floor, in front of the mop modules, before the foreign substances touch the mop modules.

The present disclosure provides a cleaner with a dust housing and an agitator integrated in it.

The present disclosure provides a cleaner with a dust housing and an agitator integrated in it, that allows easy attachment and detachment of the dust housing together with the agitator.

The present disclosure provides a cleaner capable of separating couplers used for driving the agitator at once, when a force is applied through user manipulation to remove the dust housing.

In the present disclosure, couplers used for driving the agitator can be separated at once, when a force is applied through user manipulation to remove the dust housing.

In the present disclosure, since a driven coupler is placed in the dust housing, reliability can be achieved with the transmission of driving force to the agitator.

In the present disclosure, in a sweep module with a dust housing and an agitator integrated in it, a driving apparatus for providing torque to the agitator is placed in a body, and it is possible to separate couplers for holding the agitator and the driving apparatus together, as well as disengaging the dust housing and the body, by manipulating a lever.

In the present disclosure, foreign substances on the floor can be easily collected into the dust housing even if the torque of the agitator is small, since the agitator is placed integrally with the dust housing.

In the present disclosure, a driving coupler and a driven coupler can be separated simultaneously through a single manipulation when the dust housing and the body are disengaged, because the lever and the driven coupler are assembled as one unit.

An exemplary embodiment of the present disclosure provides a cleaner comprising: a body that has an insertion slot open toward a floor, communicates with the insertion slot, has an installation space inside, and forms the exterior; a dust housing that is detachably assembled into the body through the insertion slot and comprises a collection opening surface open toward the bottom and a storage space storing foreign substances collected through the collection opening surface; an agitator rotatably assembled to the dust housing and exposed through the collection opening surface; a driving apparatus placed in the body that provides torque to the agitator; a driving coupler placed on the driving apparatus that transmits torque to the agitator; a driven coupler placed on the agitator that receives torque from the driving coupler to rotate the agitator; and a lever placed on either the driving coupler or the driven coupler that receives force through manipulation and selectively attaches or separates the driving coupler and the driven coupler.

The lever may be assembled to the driven coupler.

The cleaner may further comprise a coupling elastic member placed between the agitator and the driven coupler that provides elastic force to the driven coupler and presses the driven coupler toward the driving coupler.

When the driving coupler and the driven coupler engage, the driven coupler protrudes outward of the dust housing.

The cleaner may further comprise a side cover covering the side of the housing; wherein the driven coupler may be placed between the side cover and the dust housing, and the side cover may further comprise an opening surface through which the driven coupler pass.

The driven coupler may be placed on the side of the agitator, and the lever may be placed under the driven coupler and exposed to the insertion slot of the body.

The driven coupler may further comprise a groove formed in the outer surface, and the lever may further comprise a coupling recess that engages the groove, wherein the groove and the coupling recess may be vertically separable and engage each other in a lateral direction.

The lever may further comprise a lever locking portion protruding outward from the dust housing, and the body may further comprise: a storage housing with the installation space formed therein; and a locking groove formed in the storage housing and exposed toward the installation space, wherein the lever locking portion may engage the locking groove in the direction of gravitational force.

The lever may comprise: a first lever placed on one side of the dust housing; and a second lever placed on the other side of the dust housing, wherein the second lever may be assembled to the driven coupler, and the driving coupler and the driven coupler may be attached or separated by the movement of the second lever.

The first lever may further comprise a lever locking portion on one side, which protrudes toward one side of the dust housing, and the body may further comprise: a storage housing with the installation space formed therein; and a locking groove on one side, which is formed on one side of the storage housing and exposed toward the installation space, wherein the lever locking portion on one side may engage the locking groove on one side in the direction of gravitational force.

The second lever may further comprise a lever locking portion on the other side, which protrudes toward the other side of the dust housing, and the body may further comprise a locking groove on the other side, which is formed on the other side of the storage housing and exposed toward the installation space, wherein the lever locking portion on the other side may engage he locking groove on the other side in the direction of gravitational force.

The lever and the second lever may be exposed externally through the insertion slot, and the lower ends of the first lever and second lever may be located between the floor and the bottom of the body.

The agitator may further comprise: an agitator assembly for sweeping foreign substances on the floor into the dust housing by rotation; and an axle member attached to the side of the agitator assembly and providing the center of rotation of the agitator assembly, wherein the axle member may be configured to pass through the driven coupler.

The cleaner may further comprise a coupling stopper passing through the driven coupler, wherein the coupling stopper may be fixed to the axle member through the driven coupler.

The coupling elastic member may be placed between the axle member and the driven coupler.

The cleaner may further comprise: a first lever elastic member placed between the dust housing and the first lever; and a second lever elastic member placed between the dust housing and the second lever.

The cleaner may further comprise a housing elastic member placed on the body and exposed to the installation space, wherein the housing elastic member may elastically support the top of the dust housing.

Another exemplary embodiment of the present disclosure provides a cleaner comprising: a body that has an insertion slot open toward a floor, communicates with the insertion slot, has an installation space inside, and forms the exterior; a dust housing that is detachably assembled into the body through the insertion slot and comprises a collection opening surface open toward the bottom and a storage space storing foreign substances collected through the collection opening surface; an agitator rotatably assembled to the dust housing and exposed through the collection opening surface; a driving apparatus placed in the body that provides torque to the agitator; a driving coupler placed on the driving apparatus that transmits torque to the agitator; a driven coupler placed on the agitator that receives torque from the driving coupler to rotate the agitator; a first lever placed on one side of the dust housing that engages the body; and a second lever placed on either the driving coupler or the driven coupler that receives force through manipulation and selectively attaches or separates the driving coupler and the driven coupler.

The cleaner may further comprise: a first lever elastic member placed between the dust housing and the first lever that presses the first lever toward the body; and a second lever elastic member placed between the dust housing and the second lever that presses the second lever toward the body.

The cleaner may further comprise: a housing elastic member placed on the body and exposed to the installation space, that elastically supports the top of the dust housing.

DETAILED DESCRIPTION

Expressions referring to directions such as "front (F), rear (R), left (Le), right (Ri), up (U), and down (D)" mentioned below are defined with respect to the direction of movement of a cleaner. However, these definitions are given only for clear understanding of the present disclosure, and the directions may be defined differently depending on where the reference is placed.

The use of terms such as "first, second, third, etc." in front of the constituent elements mentioned below is intended only to avoid confusion between designated components, and do not indicate the sequence or importance of the components or the relationships between the components. For example, an embodiment including only the second component without the first component is also feasible.

The term "mop" mentioned below may apply in various ways in terms of material such as fabric or paper and may be used repeatedly by washing or used only one time.

The present disclosure may be applied to a cleaner that can be manually moved by a user or a robotic cleaner which moves on its own. Hereinafter, the present exemplary embodiment will be described with respect to a robot cleaner.

Figure 1:
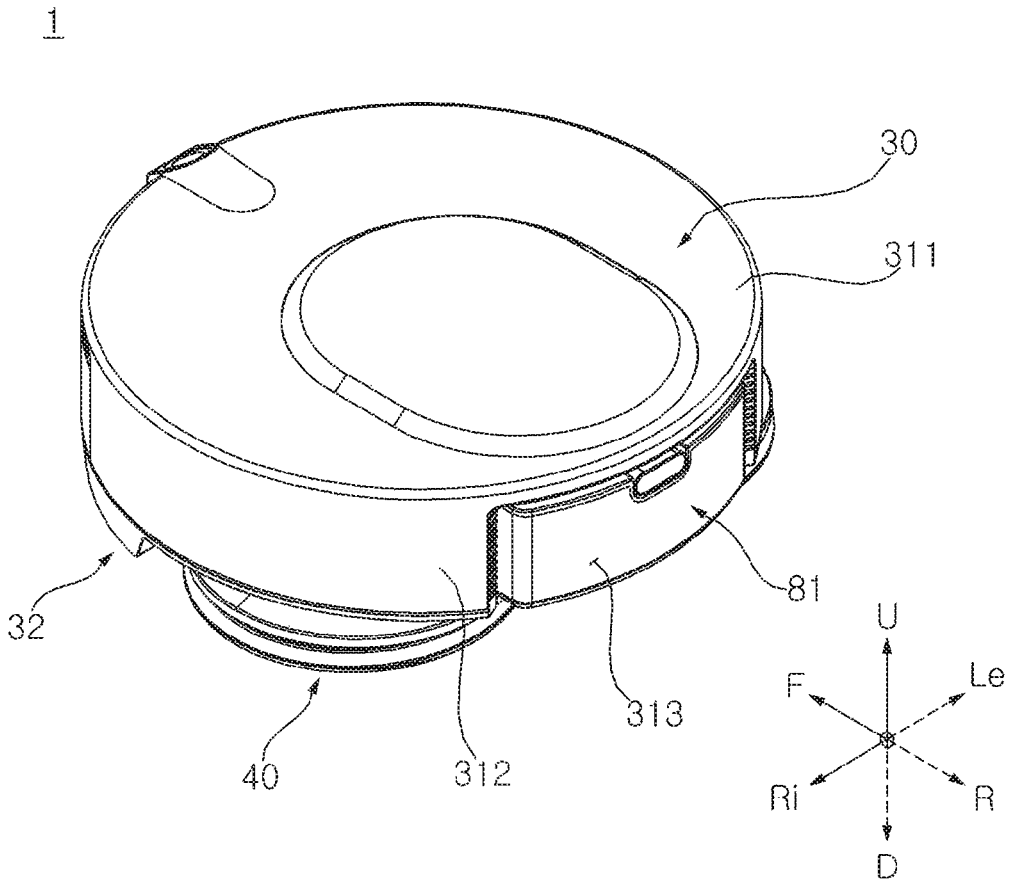
FIG. 1 is a perspective view of a cleaner according to a first exemplary embodiment of the present disclosure.
Figure 2:
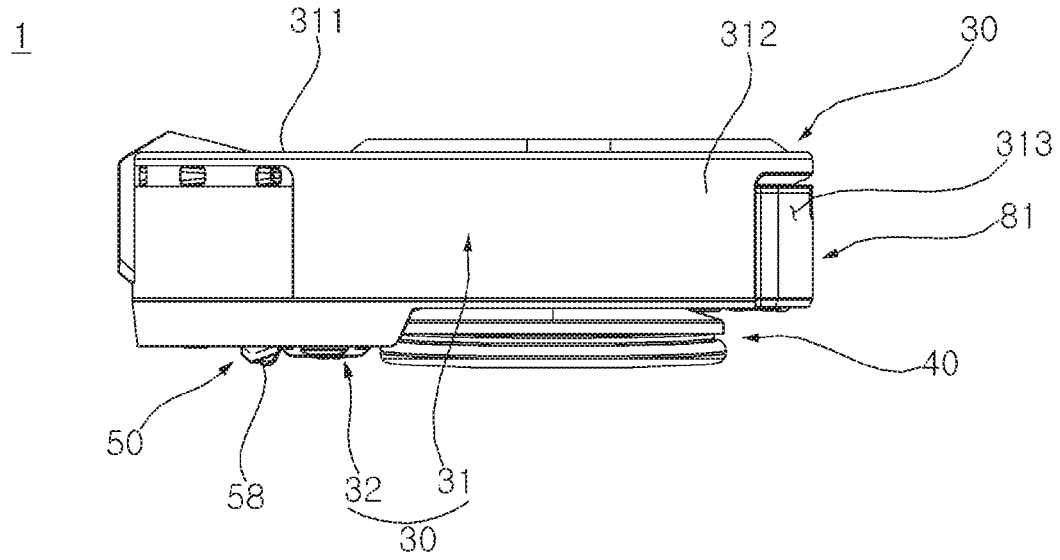
FIG. 2 is a left side view of FIG. 1.
Figure 3:
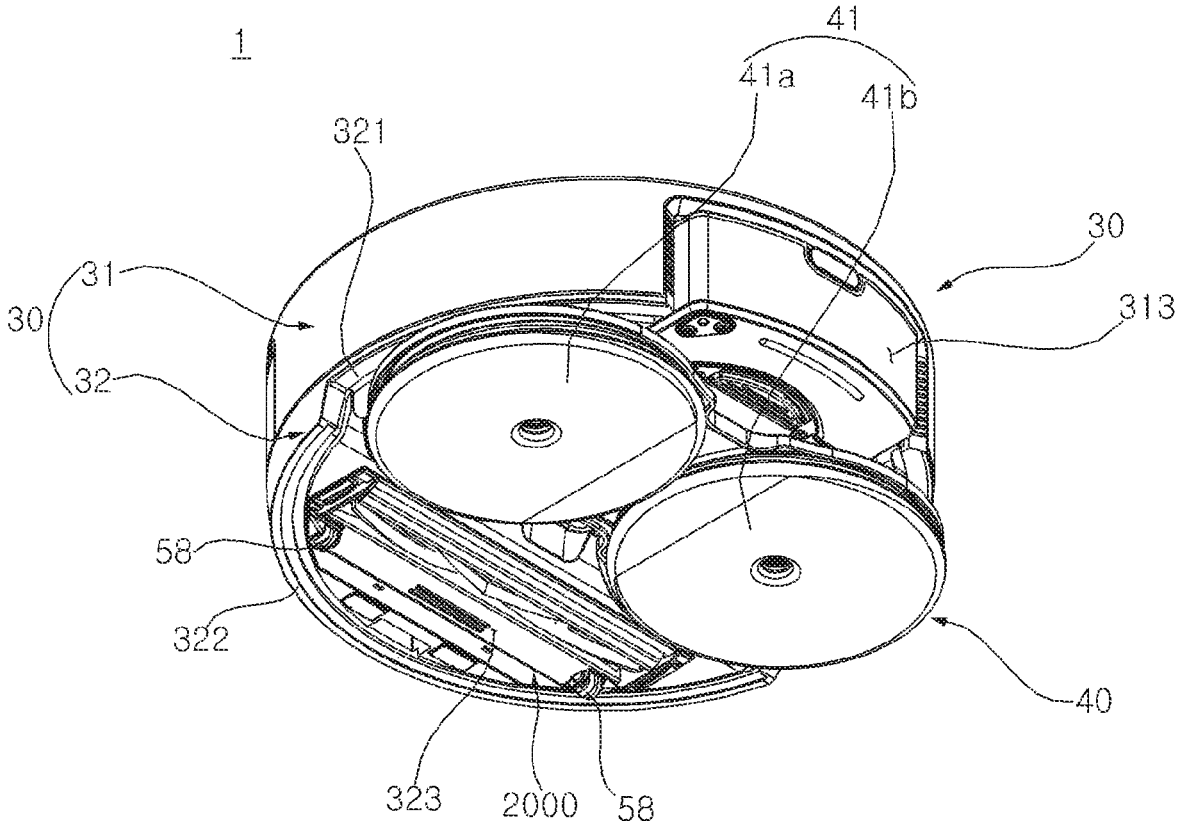
FIG. 3 is a bottom perspective view of FIG. 1.
Figure 4:
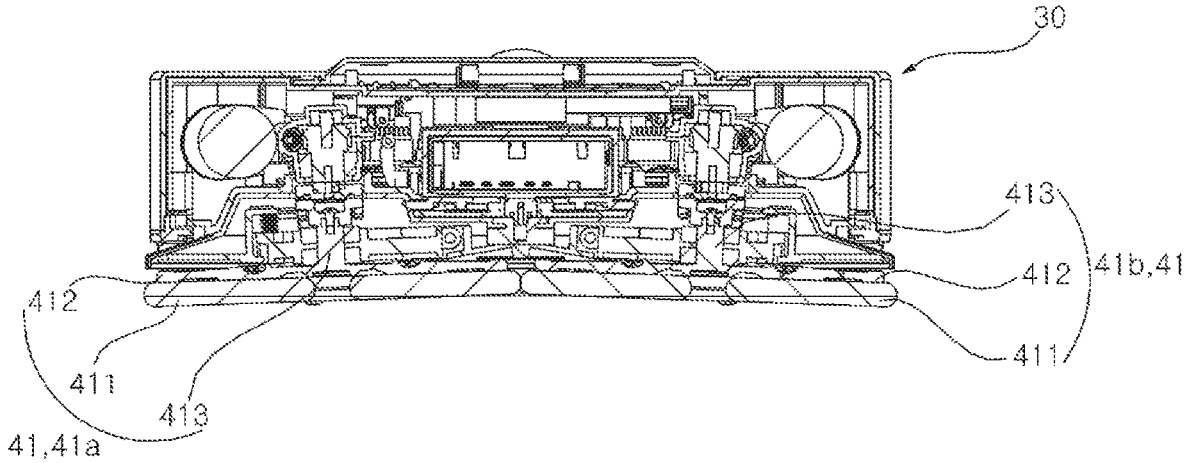
FIG. 4 is a front cross-sectional view of FIG. 1.

FIG. 1 is a perspective view of a cleaner according to a first exemplary embodiment of the present disclosure. FIG. 2 is a left side view of FIG. 1. FIG. 3 is a bottom perspective view of FIG. 1. FIG. 4 is a front cross-sectional view of FIG. 1.

Referring to FIGS. 1 to 4, a cleaner 1 according to an exemplary embodiment of the present disclosure comprises a body 30 with a controller. The cleaner 1 comprises a mop module 40 configured to do mopping in contact with a floor (target surface). The cleaner 1 comprises a sweep module 2000 configured to collect foreign substances from the floor.

The mop module 40 may be placed on the underside of the body 30 and support the body 30. The sweep module 2000 may be placed on the underside of the body 30 and support the body 30. In the present exemplary embodiment, the body 30 is supported by the mop module 40 and the sweep module 2000. The body 30 forms the exterior. The body 30 is configured to connect the mop module 40 and the sweep module 2000.

The mop module 40 may form the exterior. The mop module 40 is placed on the underside of the body 30. The mop module 40 is placed at the rear of the sweep module 2000. The mop module 40 provides driving force for moving the cleaner 1. Preferably, the mop module 40 is placed on the rear side of the cleaner 1 so as to move the cleaner 1.

The mop module 40 comprises at least one mopping portion 411 configured to mop the floor while spinning. The mop module 40 has at least one spin mop 41 and the spin mop 41 spins clockwise or counterclockwise when viewed from above. The spin mop 41 makes contact with the floor.

In the present exemplary embodiment, the mop module 40 may comprise a pair of spin mops 41*a* and 41*b*. The pair of spin mops 41*a* and 41*b* spin clockwise or counterclockwise when viewed from above, and mop the floor by the spinning motion. One of the pair of spin mops 41*a* and 41*b* placed on the left side when viewed from the front in the direction of forward movement of the cleaner is defined as a left spin mop 41*a*, and the spin mop placed on the right side is defined as a right spin mop 41*b*.

The left spin mop 41*a* and the right spin mop 41*b* spin about their respective axes of rotation. The axes of rotation are placed vertically. The left spin mop 41*a* and the right spin mop 41*b* may spin independently.

The left spin mop 41*a* and the right spin mop 41*b* each comprise a mop portion 411, a rotating plate 412, and a spin shaft 414. The left spin mop 41*a* and the right spin mop 41*b* each comprise a water supply reservoir 413.

The sweep module 2000 may form the exterior. The sweep module 2000 is placed in front of the mop module 40. Preferably, the sweep module 2000 is placed at the front in the direction of forward movement of the cleaner 1 in order to prevent foreign substances on the floor from contacting the mop module 40 first.

The sweep module 2000 is spaced apart from the mop module 40. The sweep module 2000 is placed in front of the mop module 40 and makes contact with the floor. The sweep module 2000 collects foreign substances from the floor.

The sweep module 2000 makes contact with the floor and collects foreign substances lying in front of the sweep module 2000 inside when the cleaner 1 is moving. The sweep module 2000 is placed on the underside of the body 30. The lateral width of the sweep module 2000 is smaller than the lateral width of the mop module 40.

The body 30 comprises a casing 31 forming the exterior and a base 32 placed under the casing 31.

The casing 31 forms the sides and top of the body 30. The base 32 forms the bottom of the body 30.

In the present exemplary embodiment, the casing 31 is formed in the shape of a cylinder with an open bottom. The casing 31 has an overall circular shape when viewed from the top. Its radius of rotation may be minimized since the plane of the casing 31 is circular.

The casing 31 comprises a top wall 311 having an overall circular shape, and a side wall 312 formed integrally with the top wall 311 and extending downward from the edge of the top wall 311.

A portion of the side wall 312 is made open. The opening portion of the side wall 312 is defined as a reservoir insertion slot 313, and a reservoir 81 is detachably fitted through the reservoir insertion slot 313. The reservoir insertion slot 313 is placed at the rear in the direction of forward movement of the cleaner. Since the reservoir 81 is inserted through the reservoir insertion slot 313, it is desirable that the reservoir insertion slot 313 be positioned close to the mop module 40.

The mop module 40 is attached to the base 32. The sweep module 50 is attached to the base 32. A controller Co and a battery Bt are placed in an inside space formed by the casing 31 and the base 32. Also, a mop driving apparatus 60 is placed on the body 30. A water supply module 80 is placed on the body 30.

The base 32 comprises a base body 321 covering the open bottom of the casing 31, a base guard 322 formed along the outer edge of the base body 321 and protruding downward from the edge of the base body 321, and an insertion slot 323 into which the sweep module 2000 is removably inserted.

Figure 5:
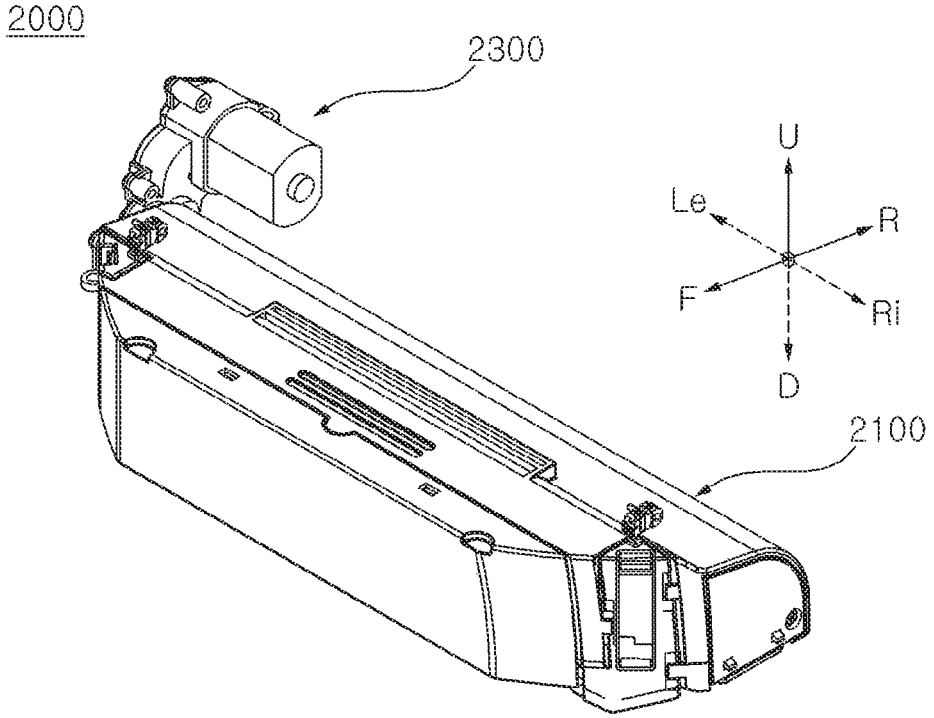
FIG. 5 is a perspective view of a sweep module illustrated in FIG. 3.
Figure 6:
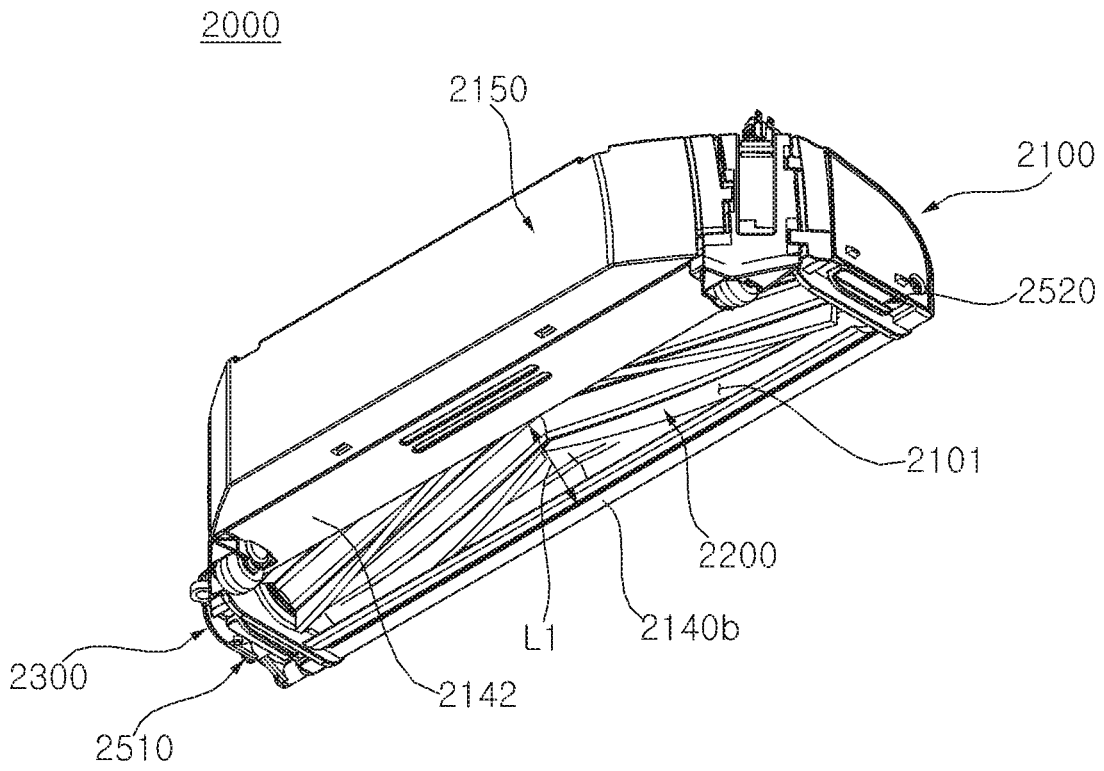
FIG. 6 is a bottom perspective view of FIG. 5.
Figure 7:
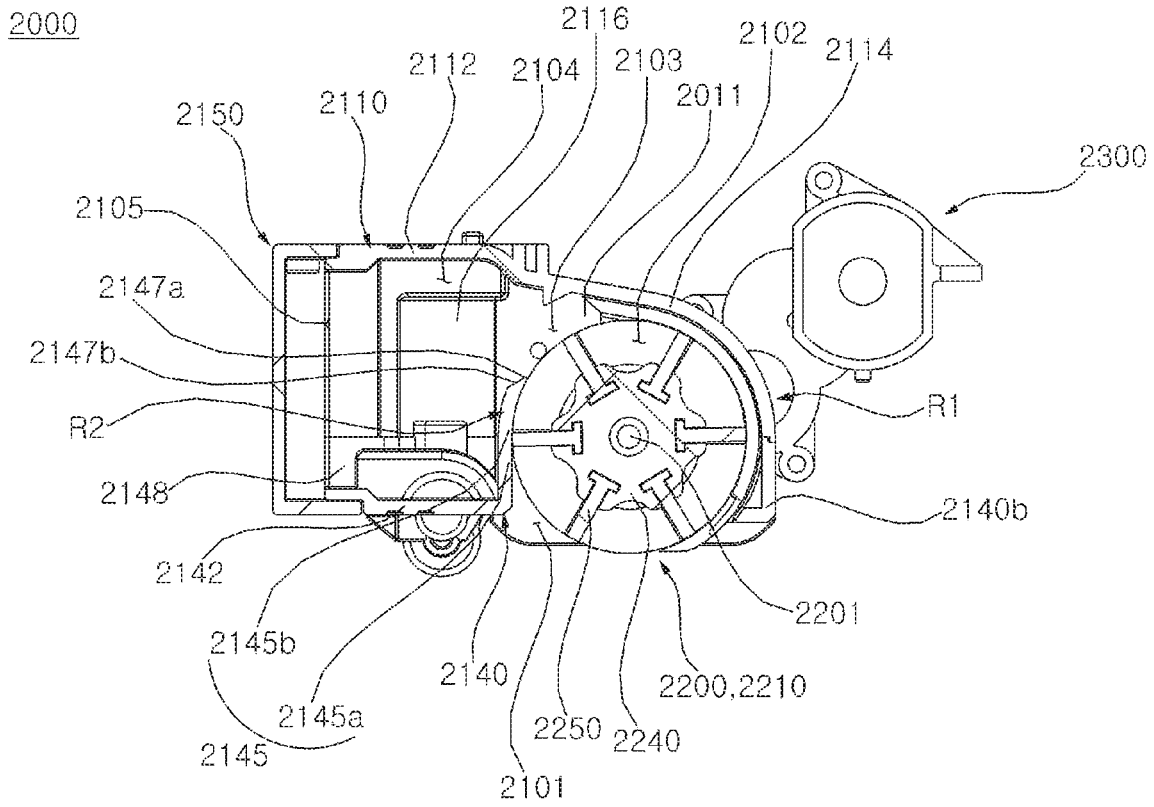
FIG. 7 is a right cross-sectional view of FIG. 5.
Figure 8:
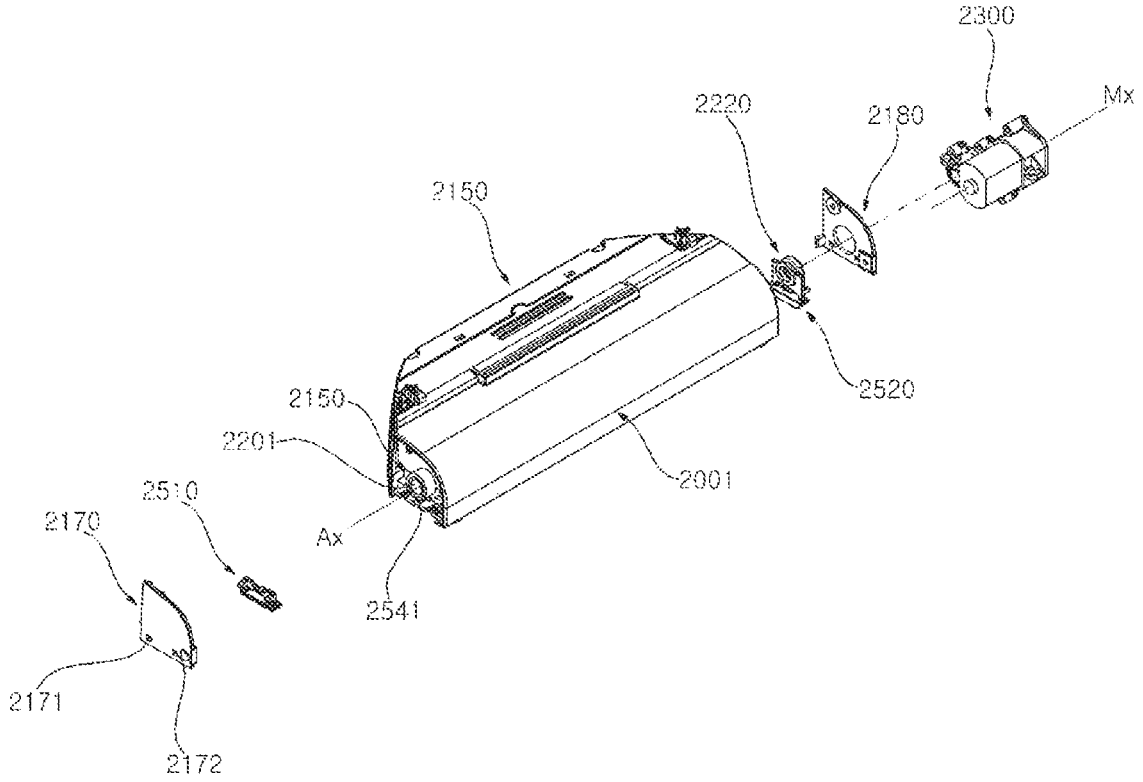
FIG. 8 is an exploded perspective view of the sweep module illustrated in FIG. 3.
Figure 9:
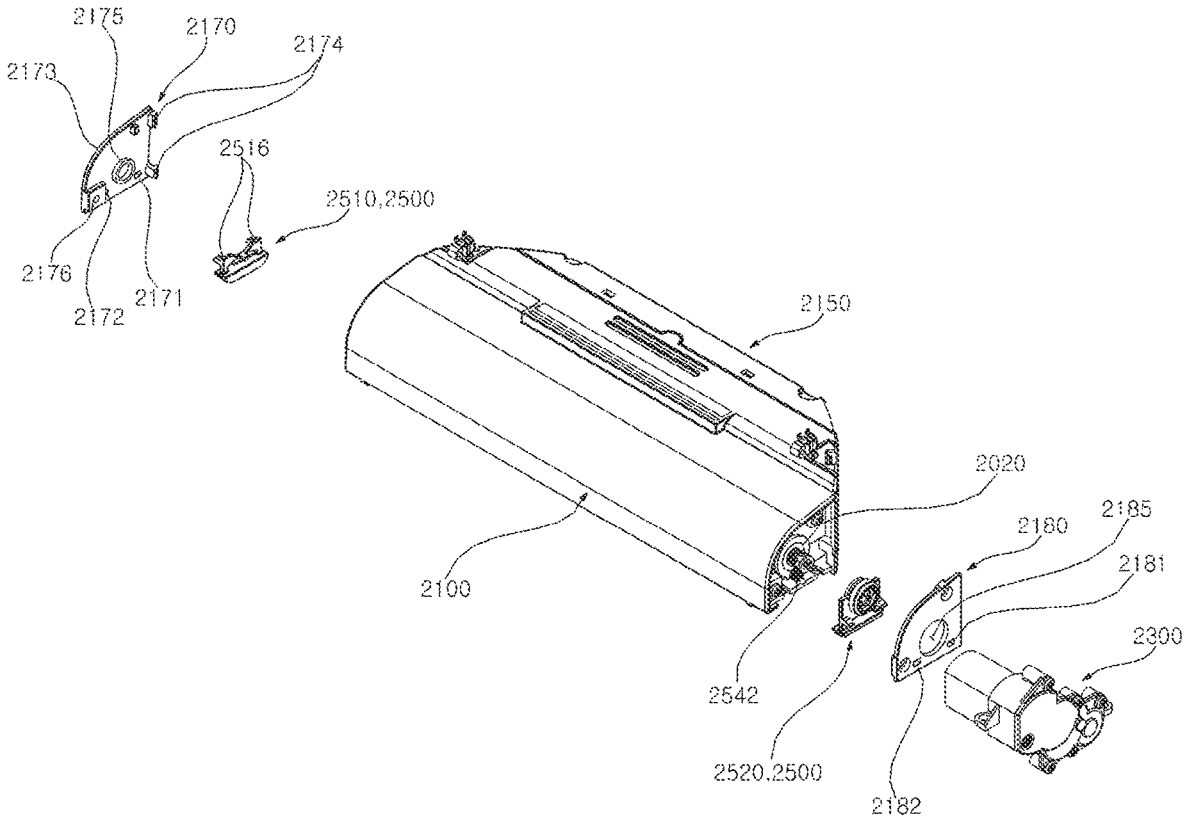
FIG. 9 is an exploded perspective view of the sweep module as viewed from the right side of FIG. 8.
Figure 10:
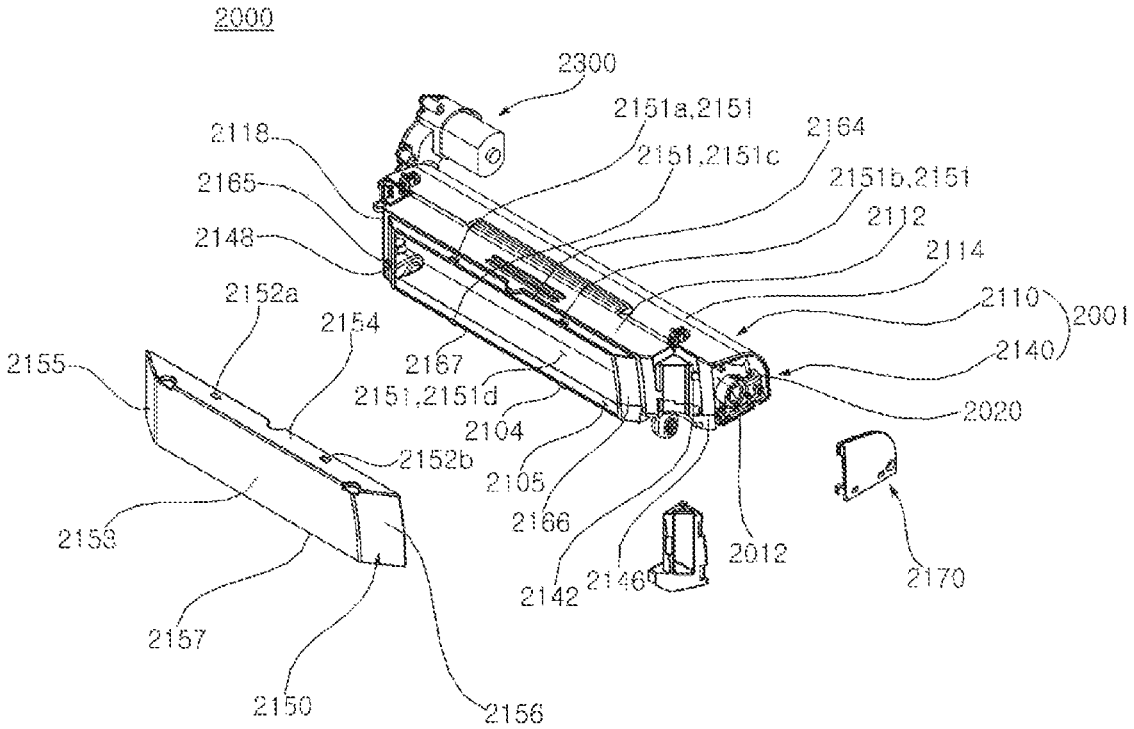
FIG. 10 is a partial exploded perspective view of FIG.

FIG. 5 is a perspective view of a sweep module illustrated in FIG. 3. FIG. 6 is a bottom perspective view of FIG. 5. FIG. 7 is a right cross-sectional view of FIG. 5. FIG. 8 is an exploded perspective view of the sweep module illustrated in FIG. 3. FIG. 9 is an exploded perspective view of the sweep module as viewed from the right side of FIG. 8. FIG. 10 is a partial exploded perspective view of FIG. 5.

Referring to FIGS. 5 to 10, the sweep module 2000 is removably mounted to the body 30 through the insertion slot 323. The sweep module 2000 is positioned further forward than the mop module 40, and collects foreign substances in front of the mop module 40. The sweep module 2000 is removably assembled to the base 32. The sweep module 2000 assembled to the base 32 is removed from the base 32 through a lever 2500.

The base 32 has an installation space 325 where the sweep module 2000 is mounted. In the present exemplary embodiment, a storage housing 326 is further provided which is assembled to the base 32 and positioned over the insertion slot 323 and forms the installation space 325.

The storage housing 326 protrudes upward from the base body 321.

The storage housing 326 is open at the bottom and communicates with the insertion slot 323. The inside space of the storage housing 326 provides the installation space 325. The installation space 325 of the storage housing 326 corresponds in shape to the sweep module 2000.

The sweep module 2000 comprises a dust housing 2100 detachably assembled to the body, for storing foreign substances, an agitator 2200 rotatably assembled to the dust housing 2100, a driving apparatus 2300 placed in the body 30 that provides torque to the agitator 2200, a driving coupler 2320 placed on the driving apparatus 2300 that transmits torque from the driving apparatus 2300 to the agitator 2200, a driven coupler 2220 placed on the agitator 2200 that transmits torque from the driving coupler 2320 to the agitator 2200, and a lever 2500 placed on the dust housing 2100 that receives force through manipulation and attaches or separates the driving coupler 2320 and the driven coupler 2220.

The dust housing 2100 accommodates the agitator 2200. Also, the dust housing 2100 stores foreign substances collected by the rotation of the agitator 2200. That is, the dust housing 2100 provides a storage space for foreign substances, as well as a structure for the installation and operation of the agitator 2200.

The dust housing 2100 comprises a collection space 2102 for the rotation of the agitator 2200 and a storage space 2104 for the storage of foreign substances. The dust housing 2100 is formed to extend laterally. The dust housing 2100 is narrower in width than the mop module 40.

The dust housing may be assembled after a structure for the collection space 2102 and a structure for the storage space 2104 are provided separately. In the present exemplary embodiment, the collection space 2102 and the storage space 2104 are placed inside the dust housing 2100, and a partition 2145 is provided to partially separate the collection space 2102 and the storage space 2104 off from each other.

In the present exemplary embodiment, the dust housing 2100 comprises an upper housing 2110 forming the appearance of the upper side, a lower housing 2140 placed under the upper housing 2110 and attached to the upper housing 2110, and a dust cover 2150 detachably assembled to at least one of the upper housing 2110 and lower housing 2140.

The collection space 2102 and the storage space 2104 are formed by assembling the upper housing 2110 and the lower housing 2140. That is, the upper housing 2110 provides a space in upper parts of the collection space 2102 and storage space 2104, and the lower housing 2140 provides the remaining space in lower parts of the collection space 2102 and storage space 2104.

In the present exemplary embodiment, the collection space 2102 is positioned at the rear of the storage space 2104.

That is, the dust cover 2150 is positioned further forward than the upper housing 2110 since the storage space 2104 is positioned further forward than the collection space 2102.

The upper housing 2110 and the lower housing 2140 are assembled together into a single unit. The upper housing 2110 and lower housing 2140 assembled as a single unit are defined as a housing assembly 2001.

The dust cover 2150 is detachably assembled to the housing assembly. When the dust cover 2150 is removed from the housing assembly, the storage space 2104 is exposed externally. The foreign substances stored in the storage space 2104 may be discarded by removing the dust cover 2150.

The upper housing 2110 forms the top, top left side, top right side, and back of the dust housing 2100. The upper housing 2110 forms the tops of the collection space 2102 and storage space 2104. The upper housing 2110 forms part of the tops of the collection space 2102 and storage space 2104.

The upper housing 2110 comprises a first upper housing portion 2112 forming a top wall of the storage space 2104, a second upper housing portion 2114 connected to and formed integrally with the first upper housing portion 2112 and forming a top wall and back wall of the collection space 2102, a third upper housing portion 2116 forming part of left walls of the collection space 2102 and storage space 2104, and a fourth upper housing portion 2118 forming part of right walls of the collection space 2102 and storage space 2104.

The first upper housing portion 2112 is not specifically limited in its shape, except that the second upper housing portion 2114 corresponds in shape to the agitator 2200 since it accommodates the agitator 2200.

The center of curvature of the second upper housing portion 2214 is at least partially on the axis of rotation of the agitator 2200. At least part of the second upper housing portion 2114 is formed in an arc shape.

In the present exemplary embodiment, the radius R1 of curvature of the second upper housing 2114 is larger than the diameter of the agitator 2200. Preferably, the outer edge of the agitator 2200 makes contact with the inside surface of the second upper housing portion 2114.

Foreign substances collected through contact between the agitator 2200 and the second upper housing portion 2114 may be moved to the collection space 2104 along the inside surface of the second upper housing portion 2114. The foreign substances collected by the agitator 2200 may fall back to the floor, if the agitator 2200 and the second upper housing 2114 are spaced apart from each other.

A collection opening surface 2101 is formed on the lower housing 2140. The collection opening surface 2101 is exposed toward the floor, and the agitator 2200 penetrates the collection opening surface 2101 and protrudes further downward than the collection opening surface 2101.

The collection opening surface 2101 is placed further rearward than the storage space 2101.

The lower housing 2140 is placed under the upper housing 2110, and forms a storage opening surface 2103, spaced apart from the upper housing 2110, In the present exemplary embodiment, the lower housing 2140 and the upper housing 2110 are vertically spaced apart from each other.

The lower housing 2140 comprises a first lower housing portion 2142 forming a bottom wall of the storage space 2104 and having the collection opening surface 2101 for collecting foreign substances, a third lower housing portion 2146 forming the remaining part of the left walls of the collection space 2102 and storage space 2104, and a fourth lower housing portion 2148 forming the remaining part of the right walls of the collection space 2102 and storage space 2104, and a partition 2145 separating the collection space 2102 and the storage space 2104 off from each other.

In the present exemplary embodiment, the first lower housing portion 2142, the third lower housing portion 2146, the fourth lower housing portion 2148, and the partition 2145 are fabricated as a single unit. Unlike the present exemplary embodiment, the first lower housing portion 2142, the third lower housing portion 2146, the fourth lower housing portion 2148, and the partition 2145 may be assembled after one of them is fabricated separately.

A left wall 2011 of the housing assembly 2001 is formed by assembling the third lower housing portion 2146 and the third upper housing portion 2116. A right wall 2012 of the housing assembly 2001 is formed by assembling the fourth lower housing portion 2148 and the fourth upper housing portion 2118.

The left axis of rotation of the agitator 2200 penetrates the left wall 2011 of the housing assembly, and the right axis of rotation of the agitator 2200 penetrates the right wall 2012 of the housing assembly.

The partition 2145 protrudes upward from the first lower housing portion 2142. The lateral length of the partition 2145 corresponds to the lateral length of the agitator 2200. The lateral length of the partition 2145 is larger than the lateral length of the agitator 2200.

The partition 2145 comprises a first partition portion **2145*a* which protrudes upward from the first lower housing portion 2142, forms the collection opening surface 2101, separates the collection space 2102 and the storage space 2104 off from each other, and makes no contact with the agitator 2200, and a second partition portion 2145*b* which extends upward from the first partition portion 2145*a*, separates the collection space 2102 and the storage space 2104 off from each other, and makes contact with the agitator 2200**.

The first partition portion **2145*a* protrudes upward from the first lower housing portion 2142. The collection opening surface 2101 is formed between the first partition portion 2145*a* and the rear end 2140*b* of the first lower housing portion 2142**.

The front-to-back length L1 of the collection opening surface 2101 is smaller than the diameter of the agitator 2200. Since the front-to-back length L1 of the collection opening surface 2101 is smaller than the diameter of the agitator 2200, the agitator 2200 cannot be taken out through the collection opening surface 2101.

The agitator 2200 is placed over the lower housing 2140, and the lower end of the agitator 2200 protrudes out of the collection opening surface 2101 and makes contact with the floor.

The first partition portion 2145*a* makes no contact with the agitator 2200.

However, the second partition portion 2145*b* may make contact with the agitator 2200.

The second partition portion 2145*b* may be formed in an arc shape. The center of curvature of the second partition portion 2145*b* may be on the axis Ax of rotation of the agitator 2200. The radius R2 of curvature of the second partition portion 2145*b* may be equal to or smaller than the diameter of the agitator 2200.

The second partition portion 2145*b* may be curved toward the agitator 2200. An upper end 2147*a* of the second partition portion 2145*b* is positioned higher than the axis Ax of rotation of the agitator 2200.

The upper end 2147*a* of the second partition portion 2145*b* protrudes further rearward than the first partition portion 2145*a*.

The upper end 2147*a* of the second partition portion 2145*b* may be pointed. The upper end 2147*a* of the second partition portion 2145*b* may have a sloping surface 2147*b*. The sloping surface 2147*b* removes foreign substances stuck on the surface of the agitator 2200 and guides the foreign substances to the collection space 2104.

A discharge surface 2105 open toward the front is formed when the upper housing 2110 and the lower housing 2140 are assembled. The discharge surface 2105 is formed on the front of the housing assembly 2001, and the dust cover 2150 opens and closes the discharge surface 2105.

The dust cover 2150 is placed in front of the housing assembly 2001, and covers the discharge surface 2105. The foreign substances in the storage space 2104 may be discharged out of the sweep module 2000 through the discharge surface 2105.

The dust cover 2150 is detachably assembled to the housing assembly 2001. In the present exemplary embodiment, the dust cover 2150 and the housing assembly 2001 are assembled by engaging each other. They may be disengaged through user manipulation.

In order for the dust cover 2150 and the housing assembly 2001 to engage each other, a protruding portion 2151 is placed on either the dust cover 2150 or the housing assembly 2001 and a locking groove 2152 is formed on the other.

In the present exemplary embodiment, the locking groove 2152 is formed on the dust cover 2150, and the protruding portion 2151 is formed on the housing assembly 2001.

The number of locking grooves 2152 corresponds to the number of protruding portions 2151. A plurality of protruding portions 2151 are provided. The protruding portions 2151 are placed on the upper housing 2110 and the lower housing 2140.

In the present exemplary embodiment, two protruding portions 2151 are placed on the upper housing 2110, and two protruding portions 2151 are placed on the lower housing 2140.

When distinction is required, the protruding portions placed on the upper housing 2110 are referred to as upper protruding portions 2151*a* and 2151*b*, and the protruding portions placed on the lower housing 2140 are referred to as lower protruding portions 2151*c* and 2151*d*.

The upper protruding portions 2151*a* and 2151*b* protrude upward from the top of the upper housing 2110, and the lower protruding portions 2151*c* and 2151*d* protrude downward from the bottom of the lower housing 2140.

The dust cover 2150 has upper locking grooves 2152*a* and 2152*b* corresponding to the upper protruding portions 2151*a* and 2151*b* and lower locking grooves 2152*c* and 2152*d* corresponding to the lower protruding portions 2151*c* and 2151*d*.

The dust cover 2150 comprises a front cover portion 2153 configured to face the discharge surface 2105, a top cover portion 2154 protruding toward the housing assembly, on the top edge of the front cover 2153, a left cover portion 2155 protruding toward the housing assembly, on the left edge of the front cover 2153, a right cover portion 2156 protruding toward the housing assembly, on the right edge of the front cover 2153, and a bottom cover portion 2157 protruding toward the housing assembly, on the bottom edge of the front cover 2153.

The dust cover 2150 has an insertion space that is recessed forward from the rear.

The upper locking grooves 2152*a* and 2152*b* are formed on the top cover portion 2154. The lower locking grooves 2152*c* and 2152*d* are formed on the bottom cover portion 2157. Preferably, the upper locking grooves 2152*a* and 2152*b* and the lower locking grooves 2152*c* and 2152*d* are positioned opposite to each other.

The upper locking grooves 2152*a* and 2152*b* or the lower locking grooves 2152*c* and 2152*d* may be formed in the shape of grooves or holes.

The housing assembly 2001 is inserted into the insertion space and has an insert portion 2160 tightly attached to the inside surface of the dust cover 2150. The insert portion 2160 is positioned in front of the upper housing 2110 and the lower housing 2140.

The insert portion 2160 comprises a top insert portion 2164 forming the top of the discharge surface 2105 and protruding forward, a left insert portion 2165 forming the left side of the discharge surface 2105 and protruding forward, a right insert portion 2166 forming the right side of the discharge surface 2105 and protruding forward, and a bottom insert portion 2167 forming the bottom of the discharge surface 2105 and protruding forward.

In the present exemplary embodiment, the top insert portion 2164, left insert portion 2165, right insert portion 2166, and bottom insert portion 2167 are connected to one another. Unlike the present exemplary embodiment, the top insert portion 2164, left insert portion 2165, right insert portion 2166, and bottom insert portion 2167 may be separated from one another. The insert portion 2160 is formed in such a way that its cross-section gets narrower toward the front from the rear.

The top insert portion 2164 is tightly attached to the top cover portion 2154, the left insert portion 2165 is tightly attached to the left cover portion 2155, the right insert portion 2166 is tightly attached to the right cover portion 2156, and the bottom insert portion 2167 is tightly attached to the bottom cover 2157.

In the present exemplary embodiment, the upper protruding portions 2151*a* and 2151*b* are formed on the top insert portion 2164. The lower protruding portions 2151*c* and 2151*d* are formed on the bottom insert portion 2167.

The upper protruding portions 2151*a* and 2151*b* are inserted upward from the bottoms of the upper locking grooves 2152*a* and 2152*b* to engage them. The lower protruding portions 2151*c* and 2151*d* are inserted downward from the tops of the lower protruding grooves 2152*c* and 2151*d* to engage them.

The dust cover 2150 or the insert portion 2160 is elastically deformed by the user's operation of pulling the dust cover 2150.

The agitator 2200 may be placed within the housing assembly 2001 and rotate within the housing assembly 2001.

The agitator 2200 may be placed between the upper housing 2110 and the lower housing 2140, Alternatively, the agitator 2200 may be placed in the upper housing 2110. In the present exemplary embodiment, the agitator 2200 is placed in the lower housing 2140, and may rotate while supported on the lower housing 2140.

The agitator 2200 may rotate forward or rearward, with its axis of rotation aligned laterally.

The housing assembly 2001 further comprises a first journal 2010 and second journal 2020 that support the agitator 2200. The first journal 2010 is placed on the left side of the housing assembly 2001, and the second journal 2020 is placed on the right side of the housing assembly 2001.

The first journal 2010 and the second journal 2020 penetrate the housing assembly 2001 in a lateral direction and communicate with the collection space 2102.

In the present exemplary embodiment, the first journal 2010 and the second journal 2020 are formed in a cylindrical shape. Unlike the present exemplary embodiment, at least one of the first and second journals may be formed in a semicylindrical shape. If the first journal and the second journal are formed in a semicylindrical shape, they are configured in such a way as to support the axis of rotation of the agitator 2200 from below.

The dust housing 2100 is mounted in the installation space 325 of the base 32, and a lever 2500 is provided to attach or separate the base 32 and the dust housing 2100.

Figure 11:
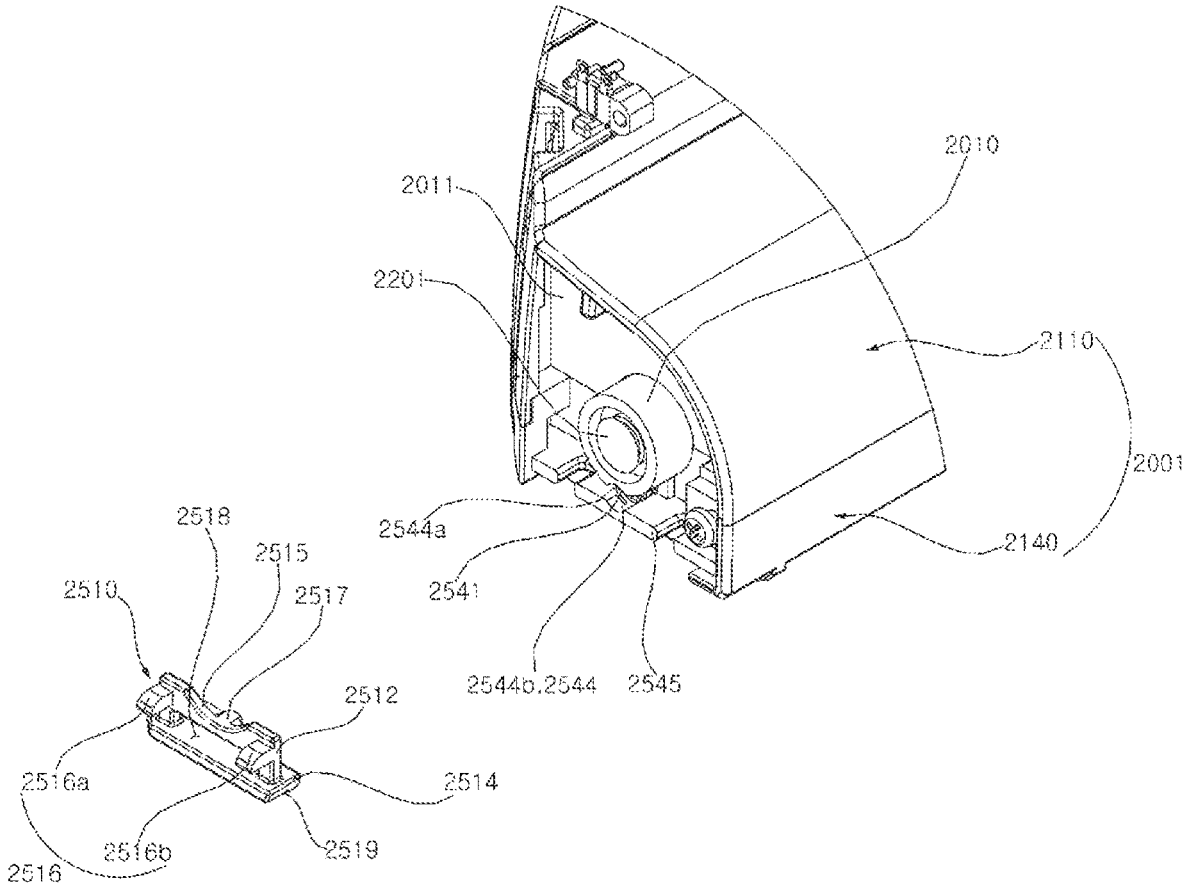
FIG. 11 is an enlarged perspective view of a first lever illustrated in FIG. 8.
Figure 12:
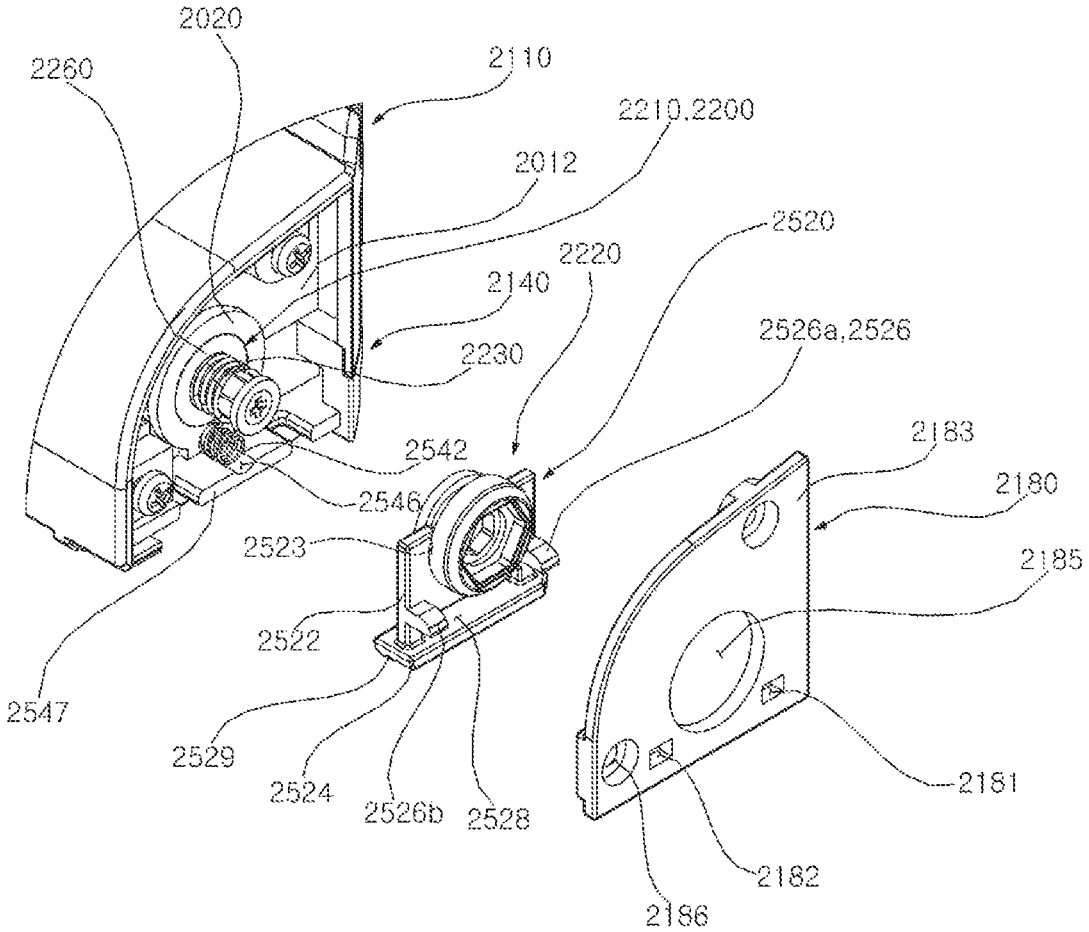
FIG. 12 is an enlarged perspective view of a second lever illustrated in FIG. 9.
Figure 13:
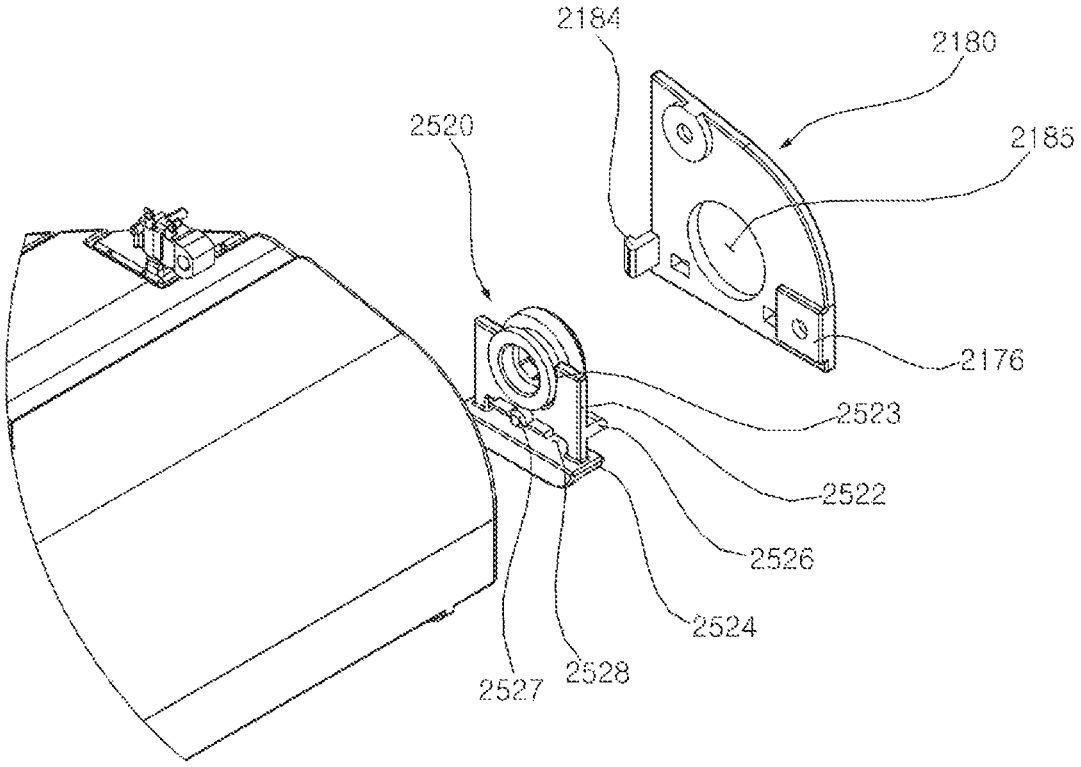
FIG. 13 is an enlarged perspective view of the second lever as viewed from the left side of FIG. 12.

FIG. 11 is an enlarged perspective view of a first lever illustrated in FIG. 8. FIG. 12 is an enlarged perspective view of a second lever illustrated in FIG. 9. FIG. 13 is an enlarged perspective view of the second lever as viewed from the left side of FIG. 12.

Referring to FIGS. 9 to 13, the lever 2500 is placed between the base 32 and the dust housing 2100, and may engage the base 32 and the dust housing 2100. The lever 2500 may engage the dust housing 2100 in the direction of gravitational force and keeps the dust housing 2100 from being removed down from the base 32.

A plurality of levers 2500 may be provided and engage the dust housing 2100 at a plurality of points. In the present exemplary embodiment, the lever 2500 comprises a first lever 2510 and a second lever 2520 which are arranged laterally.

The first lever 2510 is placed on the left side of the dust housing 2100, and the second lever 2520 is placed on the right side of the dust housing 2100.

The first lever 2510 and the second lever 2520 operate on the same mechanism but in opposite directions.

The first lever 2510 placed on the left side is moved to the right and disengaged from the base 32, and the second lever 2520 placed on the right side is moved to the left and disengaged from the base 32. The sweep module 2000 further comprises a first lever 2510 placed on one side of the housing assembly and capable of relative movement to the left and right, a second lever 2520 placed on the other side of the housing assembly and capable of relative movement to the left and right, a first lever elastic member 2541 placed between the first lever 2510 and the dust housing 2100 and providing elastic force to the first lever 2510, and a second lever elastic member 2542 placed between the second lever 2520 and the dust housing 2100 and providing elastic force to the second lever 2520.

Since the first lever 2510 and second lever 2520 have the same configuration, a description thereof will be given by taking the first lever as an example.

In the present exemplary embodiment, a first side cover 2170 and a second side cover 2180 are placed on the dust housing 2100 to cover the first lever 2510 and the second lever 2520, respectively.

Unlike the present exemplary embodiment, the first lever 2510 and the second lever 2520 may be mounted in such a way as to exposed out of the dust housing 2100, without the first side cover 2170 and the second side cover 2180. Unlike the present exemplary embodiment, the first side cover 2170 may be placed on the right side, and the second side cover 2180 may be placed on the left side.

The first side cover 2170 is attached to the left side of the housing assembly 2001. The first side cover 2170 corresponds in shape to the left side of the housing assembly 2001. The first side cover 2170 shields an axle member 2201 of the agitator 2200 from being exposed externally. The first side cover 2170 conceals most of the first lever 2510 and exposes only the components for engaging the base 32.

The first side cover 2170 comprises a first side cover body 2173 tightly attached to one side of the housing assembly 2001, through holes 2171 and 2172 configured to penetrate the first side cover body 2173, a hook portion 2174 protruding toward the housing assembly 2001 from the first side cover body 2173 and hooked to the housing assembly 2001, a journal coupling portion 2175 protruding toward the housing assembly 2001 from the first side cover body 2173 and coupled to the journal 2010 (first journal in this exemplary embodiment), and a fastening portion 2176 for attaching the first side cover body 2173 and the housing assembly 2001 by a fastening member (not shown).

The fastening portion 2176 and the hook portion 2174 are placed opposite to each other with respect to the journal coupling portion 2175. A plurality of hook portions 2174 may be provided vertically.

The journal coupling portion 2175 is inserted into the inner diameter of the first journal 2010.

The first lever 2510 comprises an upper lever body 2512 placed between the housing assembly 2001 and the first side cover 2170 and elastically supported by the first lever elastic member 2541, a lower lever body 2514 placed between the housing assembly 2001 and the first side cover 2170, formed integrally with the upper lever body 2512, exposed out of the housing assembly 2001 and receiving an input force through user manipulation, and a lever locking portion 2516 protruding from the upper lever body 2512 and configured to pass through the through holes 2171 and 2172 of the first side cover 2170.

The upper lever body 2512 is placed vertically, and the lower lever body 2514 is placed horizontally.

The lower lever body 2514 is configured to be exposed out of the dust housing 2100. The lower lever body 2514 is placed under the upper lever body 2152. The lower lever body 2514 is exposed out of the bottom of the lower housing 2140.

In the present exemplary embodiment, a manipulating portion 2519 is further provided which protrudes downward from the lower lever body 2514. The manipulating portion 2519 makes it easy to receive a force of lateral manipulation from the user because it extends longitudinally.

The user may move the first lever 2510 by pushing the manipulating portion 2519 in a lateral direction.

The lever locking portion 2516 protrudes outward from the upper lever body 2512 (toward the other side where the agitator is positioned). In the present exemplary embodiment, a first lever locking portion 2516*a* and a second lever locking portion 2516*b* are provided because the number of lever locking portions 2516 corresponds to the number of through holes.

The lever locking portion 2516 has a structure that allows engaging in the direction of gravitational force and minimizes engaging in the opposite direction to that of gravitational force. Thus, the top of the lever locking portion 2516 is rounded or sloped toward the bottom, and its bottom is flat.

If the levers 2510 and 2520 do not return to their initial positions after being moved, engaging does not occur and the sweep module 2000 may be therefore separated from its normal position. To prevent this, the sweep module 2000 further comprises a structure for guiding horizontal movement of the first lever 2510.

The sweep module 2000 comprises a first guide 2545 that protrudes toward the first lever 2510 from one side (left side in this exemplary embodiment) of the dust housing 2100 and guides the direction of movement by interference with the first lever 2510, a first guide hole 2518 formed in the first lever 2510 into which the first guide 2545 is inserted to guide the movement of the first guide 2545, a second guide 2547 that protrudes toward the second lever 2520 from the other side (right side in this exemplary embodiment) of the dust housing 2100 and guides the direction of movement by interference with the second lever 2520, and a second guide hole 2528 formed in the second lever 2520 into which the second guide 2547 is inserted to guide the movement of the second guide 2547.

The first guide 2545 is formed in the direction of movement of the first lever 2510, and the second guide 2547 is formed in the direction of movement of the second lever 2520. Thus, the first guide 2545 and the second guide 2547 are formed horizontally. The first guide hole 2518 and the second guide hole 2528 are formed horizontally so as to correspond to the first guide 2545 and the second guide 2547.

The guide holes 2518 and 2528 may be placed on either the upper lever body 2512 or the lower lever body 2514. In the present exemplary embodiment, the guide holes 2518 and 2528 are formed to penetrate the upper lever body 2512 in a horizontal direction.

One end of the first lever elastic member 2541 is supported on the dust housing 2100, and the other end is supported on the first lever 2510. The first lever elastic member 2541 elastically supports the first lever 2510 outwardly from the dust housing 2100.

The sweep module 2000 further comprises a structure for preventing displacement of the lever elastic members 2541 and 2542.

In order to keep the first lever elastic member 2541 in the same operating position, the sweep module 2000 further comprises a first position-fixing portion 2517 placed on the first lever 2510 into which the other end of the first lever elastic member 2541 is inserted, and a second position-fixing portion 2544 placed on the dust housing 2100 into which one end of the first lever elastic member 2541 is inserted.

In the present exemplary embodiment, the first lever elastic member 2541 and the second lever elastic member 2542 are coil springs. In the present exemplary embodiment, the first position-fixing portion 2517 is formed in the shape of a boss, and the second position-fixing portion 2544 is formed in the shape of a groove.

The first position-fixing portion 2517 is inserted into the first lever elastic member 2541 and the first position-fixing portion 2517 permits lateral movement of the first lever elastic member 2541. It keeps the first lever elastic member 2541 from moving longitudinally or vertically.

The second position-fixing portion 2544 is formed in the shape of a groove, into which the first lever elastic member 2541 is inserted. The second position-fixing portion 2544 permits lateral movement of the first lever elastic member 2541. It keeps the first lever elastic member 2541 from moving longitudinally or vertically.

In the present exemplary embodiment, the second position-fixing portion 2544 is placed between the first journal 2010 and the first guide 2545. The second position-fixing portion 2544 comprises a (2-1)th position-fixing portion 2544*a* concaved into a portion of the bottom of the first journal 2010 and a (2-2)th position-fixing portion 2544*b* concaved into a portion of the top of the first guide 2545.

When viewed from the side, the (2-1)th position-fixing portion 2544*a* and the (2-2)th position-fixing portion 2544*b* are curved, with their center of curvature being positioned inside the first lever elastic member 2541.

The radius of curvature of the (2-1)th position-fixing portion 2544*a* and (2-2)th position-fixing portion 2544*b* may be larger than the diameter of the first lever elastic member 2541.

Once the first lever 2510 is moved toward the housing assembly 2001 through user manipulation, the lever locking portion 2516 is disengaged from the base 32. At this point, since the first lever elastic member 2541 elastically supports the first lever 2510, once the force of the user's manipulation is eliminated, the first lever 2510 is moved back toward the first side cover 2170 and the lever locking portion 2516 protrudes out of the through holes 2171 and 2172.

By engaging the lever locking portion 2516 protruding out of the through holes 2171 and 2172 and the base 32, the sweep module 2000 may remain mounted on the base 32. Once the lever locking portion 2516 and the base 32 are disengaged from each other, the sweep module 2000 may be removed from the base 32.

In the present exemplary embodiment, since the first lever 2510 and the second lever 2520 are placed on the left and right sides of the sweep module 2000, respectively, both the first lever 2510 and the second lever 2520 need to be disengaged in order to remove the sweep module 2000 from the body 30.

The first lever 2510 allows engaging or disengaging the base 32, whereas the second lever 2520 provides a connection with the driving apparatus 2300, as well as functioning as the first lever 2510.

The second lever 2520 comprises an upper lever body 2522 placed between the housing assembly 2001 and the second side cover 2180 and elastically supported by the second lever elastic member 2542, a lower lever body 2524 placed between the housing assembly 2001 and the second side cover 2180, formed integrally with the upper lever body 2522, exposed out of the housing assembly 2001, and receiving an input force through user manipulation, a lever locking portion 2526 protruding from the upper lever body 2522 and configured to pass through the through holes 2181 and 2182 of the second side cover 2180, and a manipulating portion 2519 protruding downward from the lower lever body 2524.

When distinction between the lever locking portion 2516 of the first lever and the lever locking portion 2526 of the second lever is required, the lever locking portion 2516 of the first lever is referred to as a lever locking portion on one side, and the lever locking portion 2526 of the second lever is referred to as a lever locking portion on the other side.

The lever locking portion 2526 protrudes outward from the lower lever body 2522 (toward the other side where the agitator is positioned), and the lever locking portion 2526 comprises a first lever locking portion 2526*a* and a second lever locking portion 2526*b*.

The lever locking portion 2526 engages a locking groove 3266 formed in the storage housing 326 of the base 32.

Since the lever locking portion 2526 comprises the first lever locking portion 2526*a* and the second lever locking portion 2526*b*, the locking groove 3266 has a corresponding first locking groove 3266*a* and a second corresponding locking groove 3266*b*. The lever locking portion 2516 of the first lever 2510 likewise has a locking groove (not shown) having the same structure. The first locking groove 3266*a* and the second locking groove 3266*b* are formed in a side wall 3262 of the storage housing 326.

The first locking groove 3266*a* and the second locking groove 3266*b* are positioned lower than the driven coupler 2220 and the driving coupler 2320.

In the present exemplary embodiment, engaging occurs in the direction of gravitational force by means of the locking grooves and the lever locking portions, on one side and the other side of the sweep module 2000.

Unlike the present exemplary embodiment, only the first lever 2510 where the driven coupler is not placed may be configured to engage the base 32 in a downward direction. The other side of the sweep module 2000 may be supported on the body 30 by means of the driving coupler 2320 and driven coupler 2220 to be described later.

In the present exemplary embodiment, the sweep module 2000 is detachably attached to the body 30 by means of the locking groove on one side, the lever locking portion on one side, the locking groove on the other side, the lever locking portion on the other side, the driving coupler 2320, and the driven coupler 2220.

The second side cover 2180 comprises a second side cover body 2183 tightly attached to the other side (right side in this exemplary embodiment) of the housing assembly 2001, through holes 2181 and 2182 configured to penetrate the second side cover body 2183, a hook portion 2184 protruding toward the housing assembly 2001 from the second side cover body 2183 and hooked to the housing assembly 2001, a fastening portion 2186 for attaching the second side cover body 2183 and the housing assembly 2001 by a fastening member (not shown), and an opening surface 2185 through which the components of the driving apparatus 2300 pass to transmit the driving force of the driving apparatus 2300 to the agitator 2200.

The opening surface 2185 is placed laterally. A driving coupler 2320 of the driving apparatus 2300 to be described later is inserted through the opening surface 2185.

The sweep module 2000 comprises a second guide 2547 that protrudes toward the second lever 2520 from the other side (right side in this exemplary embodiment) of the dust housing 2100 and guides the direction of movement by interference with the second lever 2520, a second guide hole 2528 formed in the second lever 2520 into which the second guide 2547 is inserted to guide the movement of the second guide 2547, a third position-fixing portion 2527 placed on the second lever 2520 into which the other end of the second lever elastic member 2542 is inserted, and a fourth position-fixing portion 2546 placed on the dust housing 2100 into which one end of the second lever elastic member 2542 is inserted.

The agitator 2200 comprises an agitator assembly 2210 for sweeping foreign substances on the floor into the collection space 2102 by rotation, a driven coupler 2220 that receives torque from the driving apparatus 2300 and is capable of relative movement between the driving apparatus 2300 and the agitator assembly 2210, a coupling elastic member 2230 placed between the agitator assembly 2210 and the driven coupler 2200, that provides elastic force to the driven coupler 2200 and presses the driven coupler 2200 toward the driving apparatus 2300, and a coupling stopper 2270 coupled to the agitator assembly 2210 through the driven coupler 2220, that engages the driven coupler 2220 in a lateral direction to prevent detachment of the driven coupler 2220.

The agitator assembly 2210 comprises an agitator body 2240 that is placed in the collection space 2102 and rotates by receiving torque from the driving apparatus 2300, axle members 2201 that are placed on one side and the other side of the agitator body 2240, provide the center of rotation of the agitator body 2240, and are rotatably supported on the dust housing 2100, a collecting member 2250 fitted to the outer circumference of the agitator body 2240, for sweeping foreign substances into the collection space 2102, and a bearing 2260 fitted to the dust housing 2100, for providing rolling friction to the axle members 2201.

In the present exemplary embodiment, the driven coupler 220 is detachably assembled to the lever (second lever 2520 and axle member 2201 in this exemplary embodiment) and moves together with the lever. In the present exemplary embodiment, the driven coupler 2220 may be detached from the driving apparatus 2300 by the force of the user's manipulation applied to the second lever 2520.

The driven coupler 220 may move in the direction of the axle member 2201 and be detached from the driving apparatus 2300. The driven coupler 220 is capable of relative movement horizontally between the agitator assembly 2210 and the driving apparatus 2300.

The agitator body 2240 is placed laterally. The agitator body 240 is placed inside the collection space 2102.

The collecting member 2250 is formed along the outer circumference of the agitator body 2240. The collecting member 2250 protrudes radially outward from the outer circumference of the agitator body 2240. The collecting member 2250 rotates together with the rotation of the agitator body 2240. The collecting member 2250 may penetrate the collection opening surface 2101 and make contact with the floor. The collecting member 2250 may consist of multiple brushes.

When the agitator assembly 2210 rotates, the collecting member 2250 comes into contact with foreign substances on the floor and moves the foreign substances into the collection space 2102.

Figure 14:
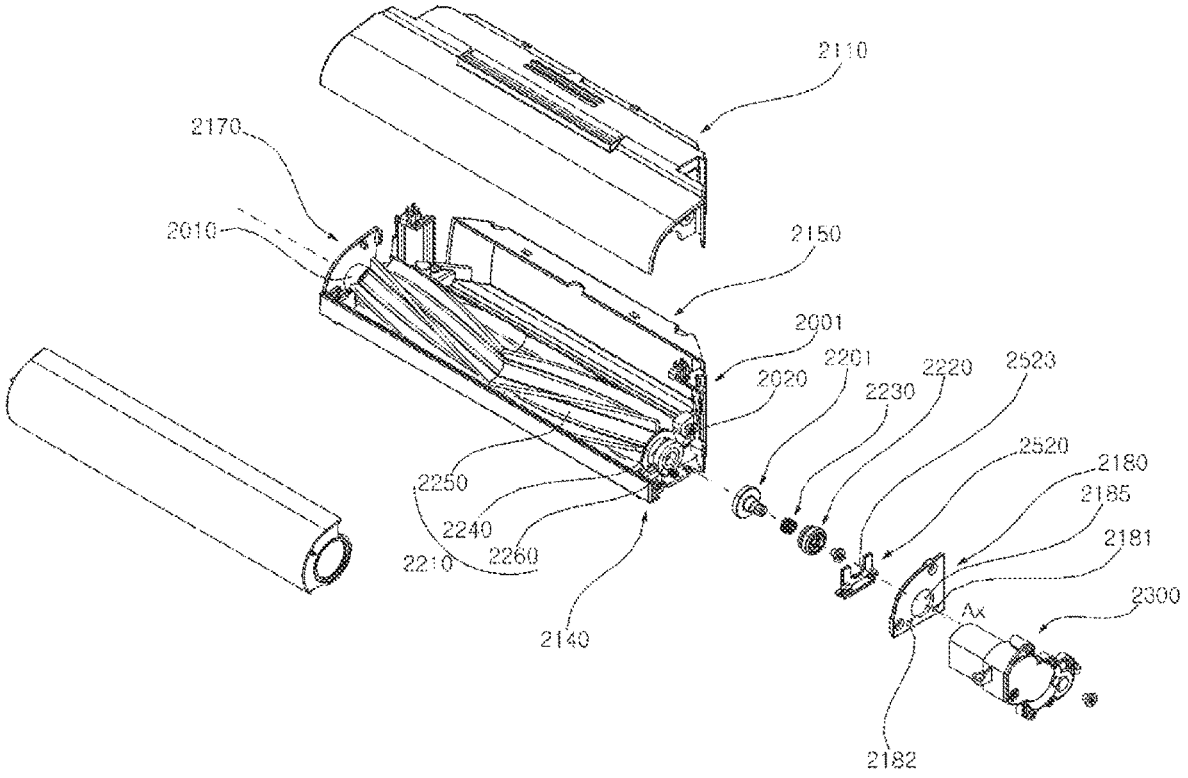
FIG. 14 is a partial exploded perspective view of a sweep module which illustrates a connecting structure of the agitator illustrated in FIG. 5.
Figure 15:
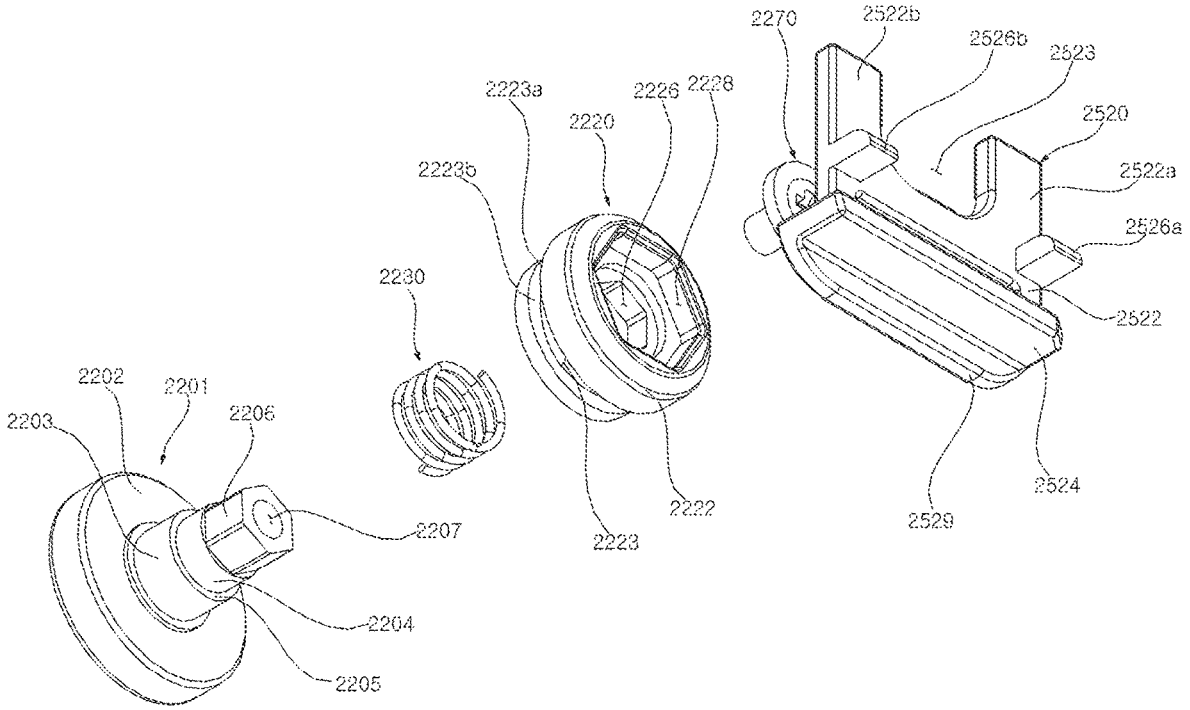
FIG. 15 is an exploded perspective view illustrating an assembly structure of the driven coupler illustrated in FIG. 14.
Figure 16:
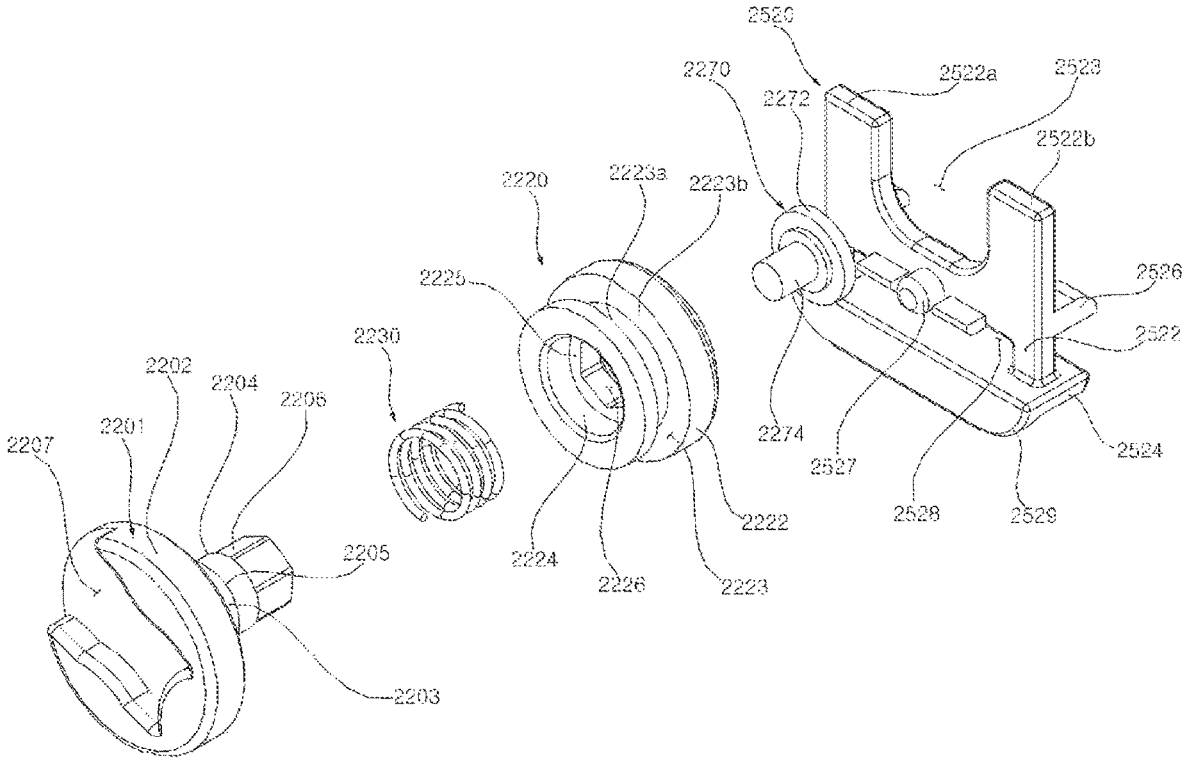
FIG. 16 is a perspective view from the left side of FIG. 15.
Figure 17:
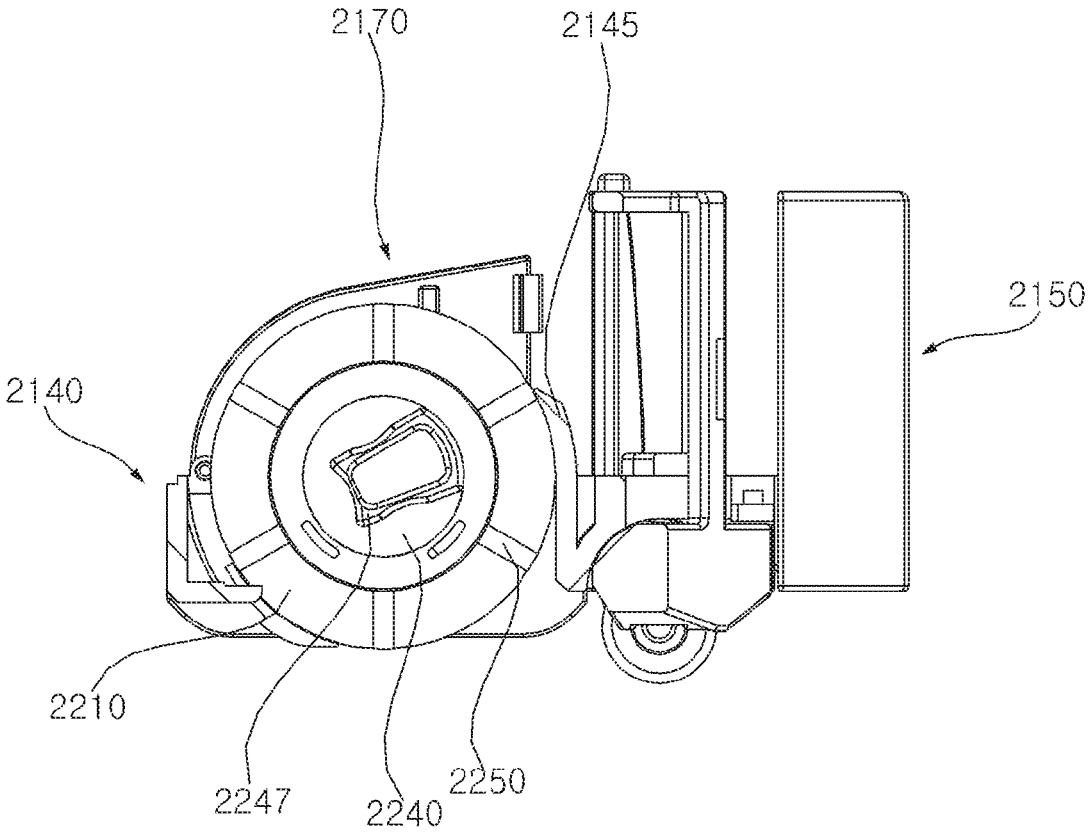
FIG. 17 is a right cross-sectional view illustrating the agitator of FIG. 14.
Figure 18:
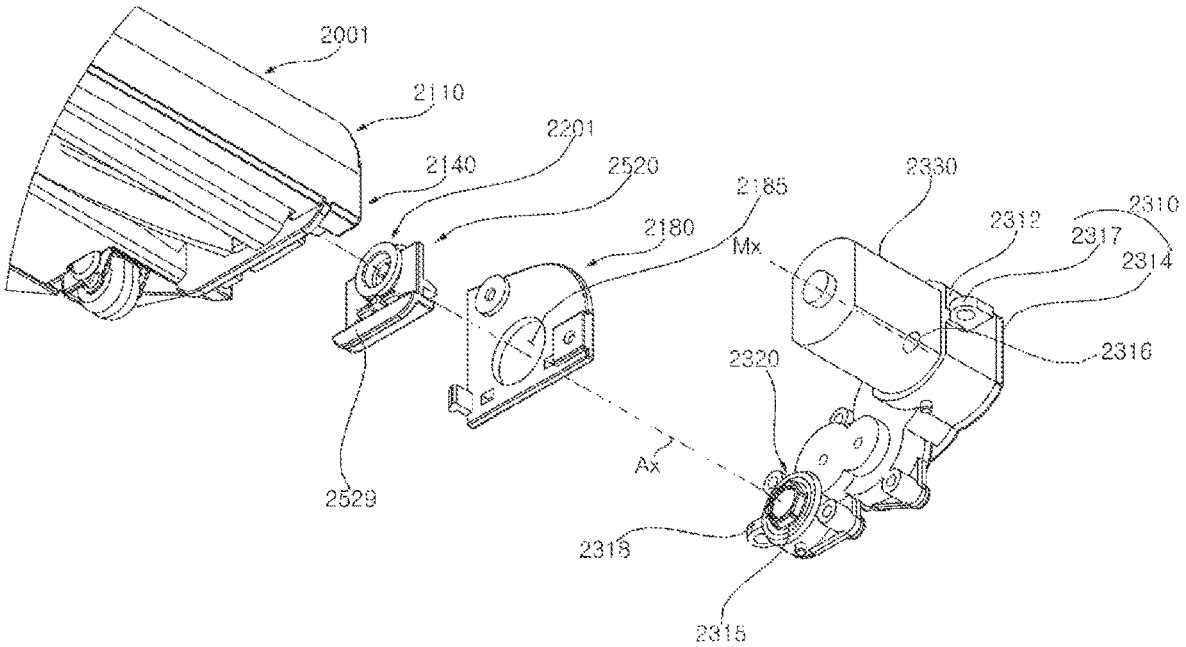
FIG. 18 is an exploded perspective view of the driving apparatus as viewed from the left side of FIG. 14.

FIG. 14 is a partial exploded perspective view of a sweep module which illustrates a connecting structure of the agitator illustrated in FIG. 5. FIG. 15 is an exploded perspective view illustrating an assembly structure of the driven coupler illustrated in FIG. 14. FIG. 16 is a perspective view from the left side of FIG. 15, FIG. 17 is a right cross-sectional view illustrating the agitator of FIG. 14. FIG. 18 is an exploded perspective view of the driving apparatus as viewed from the left side of FIG. 14.

Referring to FIGS. 12 to 18, the axle members 2201 are placed on one side and the other side of the agitator body 2240, The axle members 2201 form the center of rotation of the agitator assembly 2210.

The axle members 2201 are placed laterally. The axle members 2201 penetrate the left and right sides of the collection space 2102.

In the present exemplary embodiment, the axle members 2201 penetrate the left wall 2011 and right wall 2012 of the dust housing 2100. The axle members 2201 may be formed integrally with the agitator body 2240.

In the present exemplary embodiment, the axle members 2201 are assembled to the agitator 2240 in such a way as to be disassemblable. The axle members 2201 and the agitator body 2240 may engage in the direction of rotation of the agitator 2200 and disengage in the direction of the axis of rotation of the agitator (laterally in this exemplary embodiment).

The agitator assembly 2210 and the axle members 2201 may be detachably assembled, which enables replacement of only the agitator assembly 2210. That is, the agitator assembly 2210 may be removed from the dust housing 2100, with the axle members 2201 being assembled to the dust housing 2100.

The agitator 2200 needs periodic replacement because it is a consumable part. Through the connecting structure of the axle members 2201 and the agitator body 2240, only the agitator body 2240 may be removed from the dust housing 2100, without disassembling the entire agitator 2200. The axle members 2201 and the agitator body 2240 remain engaged.

The axle members 2201 each comprises a rotational axis body 2202 attached to the agitator body 2240, a shaft portion 2203 that protrudes toward the driving apparatus 2300 from the rotational axis body 2202, provides the center of rotation of the agitator 2200, and is attached to the bearing 2260, and a coupling guide 2204 that protrudes further toward the driving apparatus 2300 from the shaft portion 2203 and pass through the driven coupler 2220, to which the coupling stopper 2270 is attached.

The rotational axis body 2202 is formed in a disk shape. The shaft portion 2203 protrudes toward the driving apparatus 2300 from the rotational axis body 2202.

The shaft portion 2203 is smaller than the diameter of the rotational axis body 2202.

The shaft portion 2203 is formed in a cylindrical shape. The outer side of the shaft portion 2203 is inserted into the bearing 2260. The shaft portion 2203 is supported on the bearing 2260 by being inserted in it.

The coupling guide 2204 protrudes further toward the driving apparatus 2300 from the shaft portion 2203. The centers of curvature of the coupling guide 2204 and shaft portion 2203 are positioned on the same center of rotation.

The diameter of the coupling guide 2204 is smaller than the diameter of the shaft portion 2203, and a first step 2205 is formed by the difference in diameter between the coupling guide 2204 and the shaft portion 2203.

One end of the coupling elastic member 2230 is supported on the first step 2205.

The coupling guide 2204 may have a pass-through portion 2206 that passes through the driven coupler 2220. The coupling stopper 2270 is fixed to the pass-through portion 2206.

The driven coupler 2220 may move laterally along the coupling guide 2204. Since the driven coupler 2220 is elastically supported on the coupling elastic member 2230, it remains tightly attached to the driving apparatus 2300 if no external force is applied.

In the present exemplary embodiment, the coupling guide 2204 is formed in a cylindrical shape, and the pass-through portion 2206 is formed in a polygonal shape (hexagonal shape in this exemplary embodiment).

The pass-through portion 2206 is inserted into the driven coupler 2220 and engages in the direction of rotation of the agitator 2200.

Meanwhile, the axle members 2201 each have a key groove 2207 for engaging the agitator body 2240. The key groove 2207 is placed on the other side of the shaft portion 2203 with respect to the rotational axis body 2202. The key groove 2207 is placed on the side of the agitator body 2240. The key groove 2207 may be formed in an irregular polygonal shape. The key groove 2207 may be made open in the direction of the radius of the axis of rotation.

A key 2247 for insertion into the key groove 2207 is formed in the agitator body 2240. The key 2247 protrudes toward the axle member 2201 or the driven coupler 2220.

The driven coupler 2220 comprises a coupling body 2222 attached to the lever 2520 (second lever in this exemplary embodiment), a first guide groove 2224 recessed to one side (left side in this exemplary embodiment) of the coupling body 2222, into which the coupling guide 2204 and the coupling elastic member 2230 are inserted, a second guide groove 2226 communicating with the first guide groove 2224 and penetrating the coupling body 2222, into which the pass-through portion 2206 is inserted, a second step 2225 placed between the first guide groove 2224 and the second guide groove 2226, on which the first step 2205 is supported, and a power transmission groove 2228 recessed to the other side (right side in this exemplary embodiment) of the coupling body 2222, into which the driving coupler 2320 attached to the driving apparatus 2300 is detachably inserted.

The diameter of the first guide groove 2224 is larger than the diameter of the coupling elastic member 2230. The diameter of the coupling elastic member 2230 is larger than the diameter of the coupling guide 2204 and smaller than the diameter of the first guide groove 2224.

The first guide groove 2224 is formed as a circular cavity.

The second guide groove 2226 corresponds in shape to the pass-through portion 2206, and, in this exemplary embodiment, is formed as a cavity whose side is hexagonal.

The coupling body 2222 has a groove 2223 formed in the outer surface which is recessed radially inward. The diameter of the groove 2223 is smaller than the outside diameter of the coupling body 2222.

The second lever 2520 is formed on the upper lever body 2522, and has a coupling recess 2523 fitted into the groove 2223 and coupled to the driven coupler 2220.

The groove 223 is orthogonal to the center of rotation of the agitator 2200.

The second lever 2520 may be vertically attached to or separated from the driven coupler 2220, and the driven coupler 2220 may engage laterally.

The second lever 2520 further comprises a first extension 2522*a* and second extension 2522*b* extending upward from the upper lever body 2522, and the coupling recess 2523 is formed between the first extension 2522*a* and the second extension 2522*b*.

The first extension 2522*a* and the second extension 2522*b* are structures for ensuring firm assembling to the coupler 2220. The first extension 2522*a* and the second extension

2522*b* may come into contact with one side 2223*a* and the other side 2223*b* of the groove 2223.

The coupling stopper 2270 penetrates the driven coupler 2220 and is fastened to the pass-through portion 2206, The driven coupler 2220 may move laterally between the coupling stopper 2270 and the axle member 2201.

A head 2272 of the coupling stopper 2270 prevents the driven coupler 2220 from interfering with the power transmission groove 2228 and being separated to the right, A connecting portion 2274 of the coupling stopper 2270 is inserted and fastened to a fastening groove 2207 of the pass-through portion 2206.

The driving coupler 2320 is inserted into the power transmission groove 2228 and connected to it to transmit torque. The power transmission groove 228 may be formed in various shapes. In the present exemplary embodiment, the power transmission groove 2228 is hexagonal when viewed from the side.

The diameter of the power transmission groove 2228 is larger than the diameter of the second guide groove 2226. The power transmission groove 2228 and the second guide groove 2226 communicate with each other. The first guide groove 2224 is communicatively placed on one side of the second guide groove 2226, and the power transmission groove 2228 is communicatively placed on the other side.

The power transmission groove 2228 is open toward the other side, and the first guide groove 2224 is open toward one side.

When the driven coupler 2220 is attached to the upper lever body 2522, the power transmission groove 2228 is positioned on the other side of the upper lever body 2522 and the first guide groove 2224 is positioned on one side of the upper lever body 2522.

The second lever 2520 engages the driven coupler 2220 in a direction orthogonal to the axle member 2201. Also, the lever locking portion 2526 of the second lever 2520 engages the base 32.

When the driving coupler 2320 and the driven coupler 2220 engage, the driven coupler 2220 protrudes outward of the dust housing 2100. Specifically, the driven coupler 2220 penetrates the opening surface 2185 of the second side cover 2180 and protrudes further outward than the second side cover 2180.

By the operation of the second lever 2520, the driven coupler 2220 may be moved to where the opening surface 2220 is or further inward. The driven coupler 2220 needs to be moved to the outer side of the dust housing 2100 or further inward, in order to prevent interference with the base 32 and easily remove the dust housing 2100.

As such, the moving distance of the second lever 2520 needs to be greater than the combined thickness of the driven coupler 2220 and the driving coupler 2320.

When the second lever 2520 is pressed toward the agitator 2220, the second lever 2520 is moved toward the agitator 2200, and therefore the lever locking portion 2526 and the base 321 become disengaged from each other and the dust housing 2100 becomes detached from the base 32.

Moreover, when the second lever 2520 is pressed toward the agitator 2200, the coupling elastic member 2230 may be compressed and the driven coupler 2220 may be moved toward the agitator 2200.

Once the driven coupler 2220 is moved toward the agitator 2200 by the second lever 2520, the driven coupler 2220 and the driving apparatus 2300 become physically separated and the dust housing 2100 becomes separated from the base 32.

Since the sweep module 2000 according to this exemplary embodiment has the agitator 2200 fitted inside, it needs to be physically separated from the driving apparatus 2300 when separated from the base 32 of the dust housing 2100.

By the movement of the second lever 2520, the dust housing 2100 and the base 32 may be detached from each other, and, at the same time, the driven coupler 2220 and the driving apparatus 2300 are detached from each other.

Here, the second lever 2520 is concealed inside the dust housing 2100, and only the manipulating portion 2529 is exposed externally, and therefore the connecting structure of the driven coupler 2220 is not exposed externally. Notably, the second side cover 2180 shields most of the components of the second lever 2520, thereby minimizing damage to the second lever 2520 due to external impact or the like.

It is possible to minimize damage to or removal of the second lever 2520 even with repeated use, because it moves only within the dust housing 2100.

Moreover, since the side covers 2170 and 2180 conceal the levers 2510 and 2520 inside the dust housing 2100, it is possible to minimize foreign substances from coming into the lever areas 2510 and 2520 and ensure operational reliability.

Also, when the force applied to the second lever 2520 through manipulation is eliminated, the driven coupler 2220 is moved to the other side by the elastic force of the coupling elastic member 2230.

Hereupon, the driven coupler 2220 is passed through the axle member 2201 and the coupling stopper 2270 is coupled to the axle member 2201, which prevents the driven coupler 2220 from being detached from the axle member 2201. That is, the driven coupler 2220 may move along the axis of the axle member 2201, but may be kept from being detached by the coupling stopper 2270.

The driving apparatus 2300 comprises a drive housing 2310 assembled to the body 30, a motor 2330 assembled to the drive housing 2310, a power transmission assembly 2340 placed inside the drive housing 2310 and assembled to the motor to receive torque, and a driving coupler 2320 attached to the power transmission assembly 2340 and selectively meshing with the driven coupler 2220.

Since the agitator 2200 is placed inside the sweep module 2000 and the motor 2330 is placed inside the body 30, the driving coupler 2320 and driven coupler 2220 which transmit torque from the motor 2330 to the agitator 2200 are selectively detachable. The dust housing 2100 cannot be separated from the body 30 unless the driving coupler 2320 and driven coupler 2220 are separable.

The drive housing 2310 may be fixed to the body 30, in this exemplary embodiment, to the base 32. The drive housing 2310 is a structure for mounting the power transmission assembly 2340 and the motor 2330.

The drive housing 2310 may be formed in various shapes. In the present exemplary embodiment, the drive housing 2310 conceals the power transmission assembly 2340 inside and only exposes the motor 2330 and the driving coupler 2320.

The drive housing 2310 has a first drive housing 2312 and second drive housing 2314 forming the exterior, a coupling fitting portion 2315 placed on either the first drive housing 2312 or the second drive housing 2314, where the driving coupler 2320 is placed, and a hole 2316 placed on either the first drive housing 2312 or the second drive housing 2314, through which a motor shaft (not shown) passes through.

The power transmission assembly 2340 is placed between the first drive housing 2312 and the second drive housing 2314.

In the present exemplary embodiment, the first drive housing 2312 is placed on one side (the side of the agitator 2200), and the second drive housing 2314 is placed on the other side (the outer side).

In the present exemplary embodiment, the coupling fitting portion 2315 is placed on the first drive housing 2312. The driving coupler 2320 is placed on the coupling fitting portion 2315 and connected to the power transmission assembly 2340. The driving coupler 2320 may rotate while fitted to the coupling fitting portion 2315.

The driving coupler 2320 corresponds in shape to the power transmission groove 2228 of the driven coupler 2220. In the present exemplary embodiment, the driving coupler 2320 is hexagonal when viewed from the side. The driving coupler 2320 may selectively mesh with the driven coupler 2220 through the opening surface 2185 of the second side cover 2180.

The driving coupler 2320, while assembled to the drive housing 2310, protrudes toward the second side cover 2180 further than one side (left side) of the first drive housing 2312.

The center of rotation of the driving coupler 2320 is placed laterally, and may coincide with the center of rotation of the agitator 2200.

In the present exemplary embodiment, a space is formed inside the first drive housing 2312, and the power transmission assembly 2340 is rotatably fitted in the space. The second drive housing 2314 is in the shape of a cover that covers the first drive housing 2312.

The drive housing 2310 further comprises a first fastening portion 2317 and a second fastening portion 2318. The first fastening portion 2317 and the second fastening portion 2318 are placed on the first drive housing 2312. The first fastening portion 2317 and the second fastening portion 2318 are formed such that a fastening member is vertically mounted.

The motor shaft of the motor 2330 is placed laterally. The motor 2330 may be placed on one side or the other side of the drive housing 2310.

The motor 2330 is placed to face the inside of the body 30 from the drive housing 2310. By placing the motor 2330 on the side of the agitator 2200, the volume of the body 30 may be minimized.

In the present exemplary embodiment, the direction Mx of the motor shaft of the motor 2330 and the axis Ax of rotation of the agitator 2200 are parallel to each other. In the present exemplary embodiment, the center of rotation of the agitator 2200, the center of rotation of the axle member 2201, the center of the driven coupler 2220, and the center of the driving coupler 2320 are positioned on the line of the axis Ax of rotation of the agitator 2200.

In the present exemplary embodiment, the motor 2330 is positioned higher than the dust housing 2100. The motor 2330 is positioned further rearward than the dust housing 2100. The motor 2330 is positioned higher than the installation space 325 and storage housing 326 of the base 32.

The power transmission assembly 2340 comprises a plurality of gears. The number and shape of gears in the power transmission assembly 234 may vary depending on the number of rotations and torque for transmission.

Figure 19:
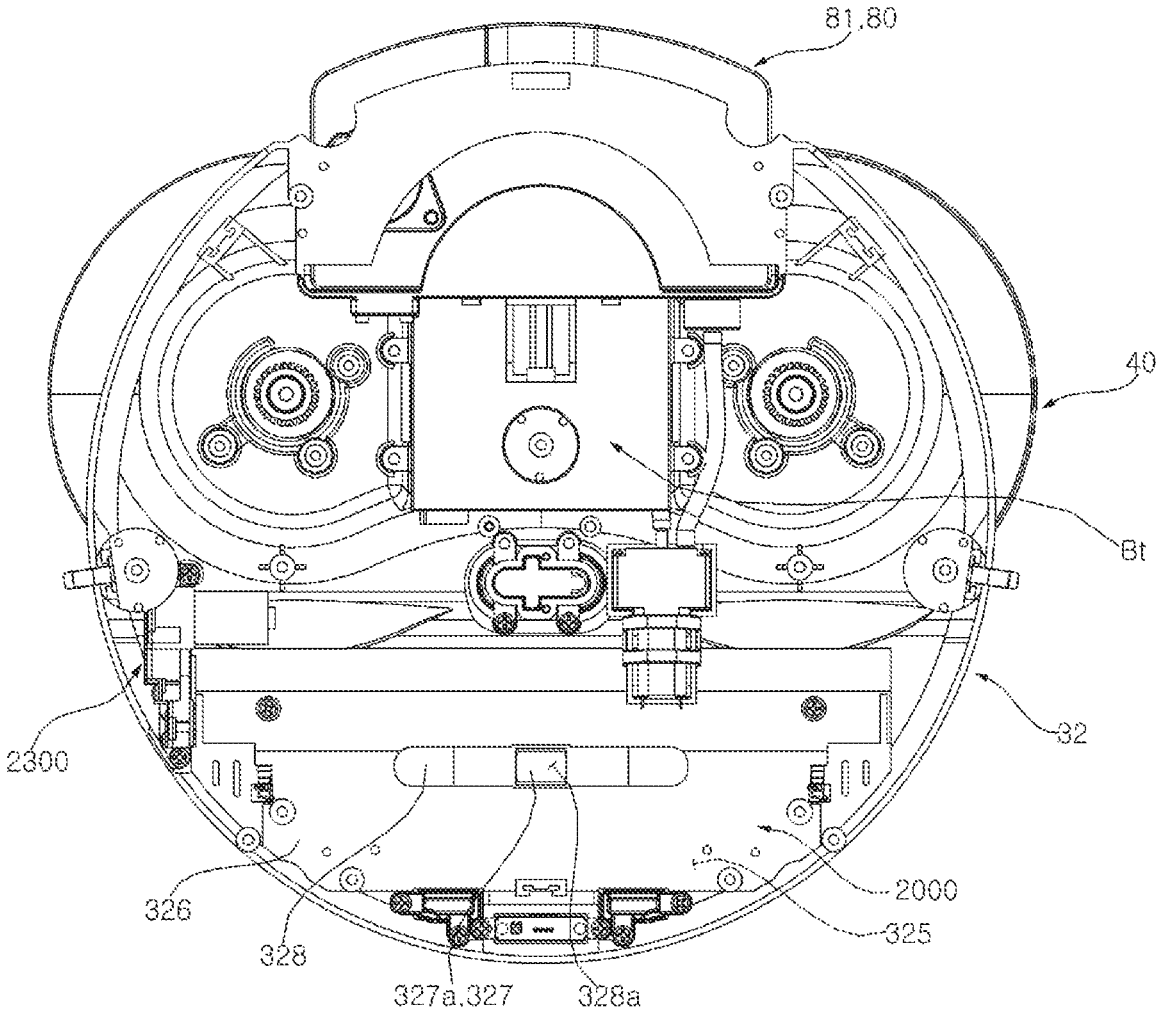
FIG. 19 is a top plan view of the cleaner of FIG. 1 from which the casing is removed.
Figure 20:
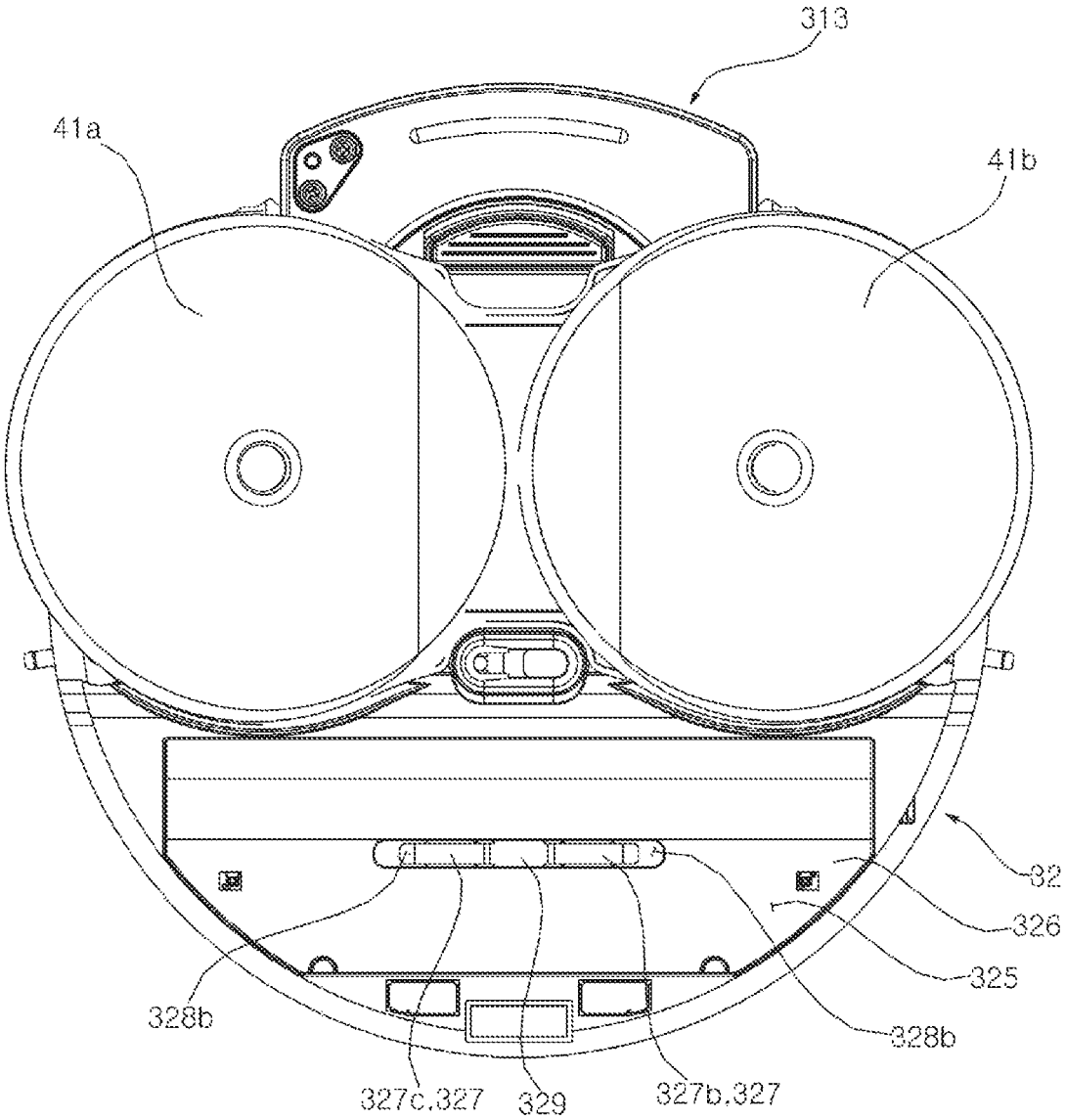
FIG. 20 is a bottom view of FIG. 19.
Figure 21:
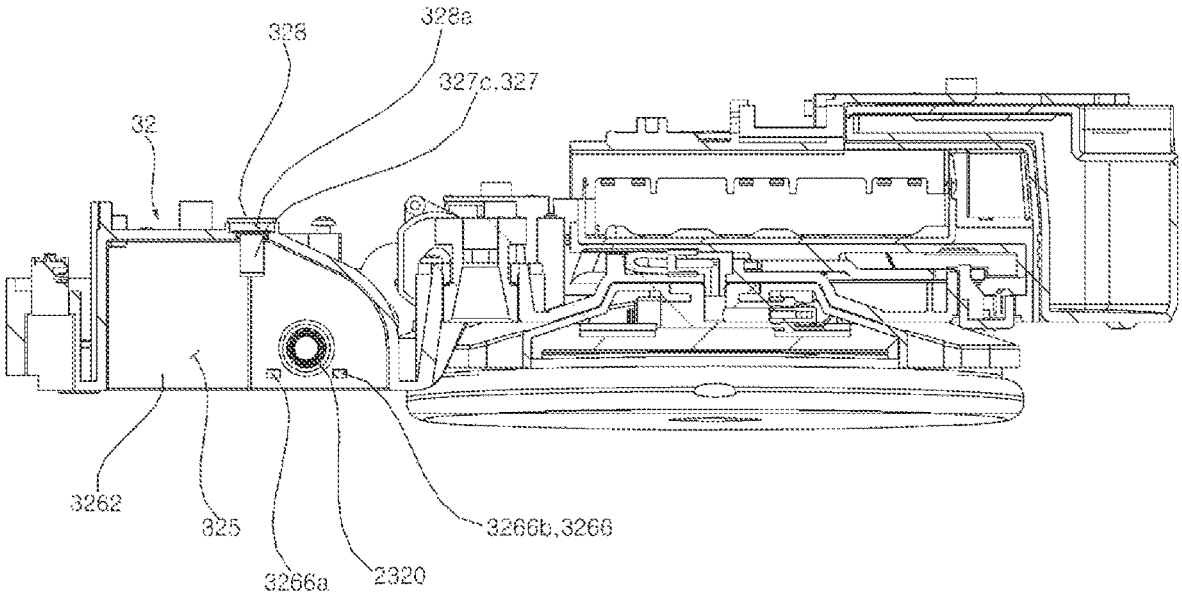
FIG. 21 is a right cross-sectional view of FIG. 19.

FIG. 19 is a top plan view of the cleaner of FIG. 1 from which the casing is removed. FIG. 20 is a bottom view of FIG. 19. FIG. 21 is a right cross-sectional view of FIG. 19.

Referring to FIGS. 19 to 21 the sweep module 2000 further comprises a housing elastic member 327 that provides elastic force to the dust housing 2100. The housing elastic member 327 is placed in the installation space 325.

The housing elastic member 327 is placed at the base 32, more specifically, in the storage housing 326. In the present exemplary embodiment, a plate spring is used as the housing elastic member 327. An installation structure for insertion and fixation is placed in the storage housing 326 in order to mount a plate spring-shaped housing elastic member 327.

The housing elastic member 327 elastically supports the top of the dust housing 2100.

The storage housing 326 has an elastic member storage portion 328 protruding upward from the installation space 325. An elastic member storage space **328*b* is formed in a lower part of the elastic member storage portion 328 to store the housing elastic member 327**.

The elastic member storage portion 328 further comprises an elastic member opening surface **328*a* which is vertically open. The elastic member opening surface 328*a* communicates with the elastic member storage space 328*b* and the installation space 325**.

Moreover, an elastic member supporting portion 329 is provided which is placed under the elastic member storage space **328*b* and connected to the storage housing 326**.

The elastic member supporting portion 329 is positioned lower than the elastic member storage portion 328.

The housing elastic member 327 is inserted between the elastic member storage portion 328 and the elastic member supporting portion 329, and the housing elastic member 327 is exposed to the top of the storage housing 326 through the elastic member opening surface **328*a***.

The housing elastic member 327 is positioned on both sides of the elastic member supporting portion 329.

The elastic member storage portion 328 extends laterally, and the elastic member supporting portion 329 is placed laterally.

The housing elastic member 327 comprises a first elastic portion **327*a* positioned above the elastic member supporting portion 329, a second elastic portion 327*b* extending to one side (the left side in this exemplary embodiment) from the first elastic portion 327*a* and placed in the elastic member storage space 328*b*, and a third elastic portion 327*c* extending to the other side (the right side in this exemplary embodiment) from the first elastic portion 327*a* and placed in the elastic member storage space 328*b***.

The second elastic portion **327*b* and the third elastic portion 327*c* are formed by bending the first elastic portion 327*a***.

The second elastic portion **327*b* and the third elastic portion 327*c* are positioned in the lower part of the elastic member storage portion 328. The second elastic portion 327*b* is sloped toward the left bottom, and the third elastic portion 327*c*** is sloped toward the right bottom.

When the dust housing 2100 is inserted into the installation space 325, the second elastic portion **327*b* and the third elastic portion 327*c* elastically support the top of the dust housing 2100**.

When the dust housing 2100 and the base 32 are disengaged from each other by the first lever 2510 and the second lever 2520, the second elastic portion **327*b* and the third elastic portion 327*c* push the dust housing 2100 downward and moves the dust housing 2100 out of the storage housing 326**.

The user can easily remove the dust housing 2100 from the installation space 325 by the elastic force of the housing elastic member 327.

Since the elastic member supporting portion 329 supports the housing elastic member 327, the housing elastic member 327 is kept from being detached from the installation space 325. Even if the dust housing 2100 is repeatedly mounted and removed, the housing elastic member 327 is firmly supported by the elastic member supporting portion 329.

The first advantage of the present disclosure is that couplers used for driving the agitator can be separated at once, when a force is applied through user manipulation to remove the dust housing.

The second advantage of the present disclosure is that, in a sweep module with a dust housing and an agitator integrated in it, a driving apparatus for providing torque to the agitator is placed in a body, and it is possible to separate couplers for holding the agitator and the driving apparatus together, as well as disengaging the dust housing and the body, by manipulating a lever.

The third advantage of the present disclosure is that foreign substances on the floor can be easily collected into the dust housing even if the torque of the agitator is small, since the agitator is placed integrally with the dust housing.

The fourth advantage of the present disclosure is that a driving coupler and a driven coupler can be separated simultaneously through a single manipulation when the dust housing and the body are disengaged, because the lever and the driven coupler are assembled as one unit.

The fifth advantage of the present disclosure is that, since a housing elastic member placed in an installation space elastically supports the dust housing, the dust housing can be easily taken out from the installation space by the elastic force of the housing elastic member.

The sixth advantage of the present disclosure is that, since a driven coupler is placed in the dust housing and the driven coupler is assembled to the agitator, reliability can be achieved with the transmission of driving force from the driving coupler to the driven coupler.

The seventh advantage of the present disclosure is that, since the housing elastic member pushes the dust housing downward when a first lever and a second lever are released, the dust housing can be easily removed.

The eighth advantage of the present disclosure is that, since the driven coupler and the lever are concealed by a side cover, the driven coupler is prevented from exposure and damage due to external impact.

The ninth advantage of the present disclosure is that, since a coupling stopper restricts the movement of the lever and driven coupler, even with the coupling elastic member elastically supporting the driven coupler, the driven coupler is prevented from being removed from the dust housing.

The tenth advantage of the present disclosure is that the driven coupler is placed outside a storage space where foreign substances are stored, thereby avoiding the driven coupler getting clogged with foreign substances and minimizing operational failures.

What is claimed is:

1. A cleaner comprising:

a body including an insertion slot open toward a floor and an installation space disposed within the body;

a dust housing detachably connected to the body, including a collection opening surface open toward the bottom, and a storage space configured to store foreign substances collected through the collection opening surface;

an agitator rotatably connected to the dust housing and exposed through the collection opening surface;

a driving apparatus disposed in the body;

a driving coupler coupled to the driving apparatus and configured to be rotated by the driving apparatus;

a driven coupler coupled to the agitator, the driven coupler configured to be rotated by the driving coupler; and a lever disposed on one of the driving coupler or the driven coupler and configured to selectively attach or separate the driving coupler and the driven coupler.

2. The cleaner of claim 1, wherein the lever is attached to the driven coupler.

3. The cleaner of claim 1, further comprising a coupling elastic member positioned between the agitator and the driven coupler and configured to force the driven coupler toward the driving coupler.

4. The cleaner of claim 3, wherein the driven coupler is configured to protrude outward from the dust housing, when the driving coupler engages with the driven coupler.

5. The cleaner of claim 3, wherein the agitator further comprises:

an agitator assembly configured to sweep foreign substances on the floor into the dust housing; and an axle member attached to a side of the agitator assembly and configured to extend through the driven coupler.

6. The cleaner of claim 5, further comprising a coupling stopper attached to the axle member, the coupling stopper configured to extend through the driven coupler.

7. The cleaner of claim 6, wherein the coupling elastic member is positioned between the axle member and the driven coupler.

8. The cleaner of claim 1, further comprising a side cover configured to cover a side of the dust housing, wherein the driven coupler extends through an opening in the side cover and is positioned between the side cover and the dust housing.

9. The cleaner of claim 1, wherein the driven coupler is positioned on a side of the agitator, and the lever is positioned under the driven coupler such that the lever is exposed to the insertion slot.

10. The cleaner of claim 1, wherein the driven coupler comprises a groove in an outer surface of the driven coupler, and the lever comprises a coupling recess configured to engage the groove, wherein the groove and the coupling recess are vertically separable and configured to engage each other in a lateral direction.

11. The cleaner of claim 1, wherein the lever comprises a lever locking portion protruding outward from the dust housing, and the body comprises a storage housing including the installation space and a locking groove, and wherein the lever locking portion is configured to engage the locking groove.

12. The cleaner of claim 1, wherein the lever comprises:

a first lever disposed on one side of the dust housing; and a second lever disposed on an opposite side of the dust housing, wherein the second lever is attached to the driven coupler, and configured to selectively attach or separate the driving coupler and the driven coupler.

13. The cleaner of claim 12, wherein the first lever comprises a first lever locking portion on the one side of the dust housing, the first lever locking portion protruding toward the one side of the dust housing, and the body comprises a storage housing including the installation space and a locking groove disposed on one side of the storage housing, wherein the first lever locking portion on the one side of the dust housing is configured to engage the locking groove on the one side of the storage housing.

14. The cleaner of claim 13, wherein the second lever comprises a second lever locking portion on the other side of the dust housing, the second lever locking portion protruding toward the other side of the dust housing, and the storage housing comprises a locking groove formed on an other side of the storage housing, wherein the second lever locking portion on the other side of the dust housing is configured to engage the locking groove on the other side of the storage housing.

15. The cleaner of claim 12, wherein the first lever and the second lever are exposed through the insertion slot, and lower ends of the first lever and second lever are located between the floor and the bottom of the body.

16. The cleaner of claim 12, further comprising:

a first lever elastic member positioned between the dust housing and the first lever; and a second lever elastic member positioned between the dust housing and the second lever.

17. The cleaner of claim 1, further comprising a housing elastic member disposed on the body and configured to support the top of the dust housing.

18. A cleaner comprising:

a body including an insertion slot open toward a floor and an installation space disposed within the body;

a dust housing detachably connected to the body and including a collection opening surface open toward the bottom and a storage space configured to store foreign substances collected through the collection opening surface;

an agitator rotatably assembled to the dust housing and exposed through the collection opening surface;

a driving apparatus disposed in the body;

a driving coupler coupled to the driving apparatus and configured to be rotated by the driving apparatus;

a driven coupler coupled to the agitator and configured to be rotated by the driving coupler;

a first lever disposed on one side of the dust housing; and a second lever disposed on one of the driving coupler or the driven coupler and configured to selectively attach or separate the driving coupler and the driven coupler.

19. The cleaner of claim 18, further comprising:

a first lever elastic member positioned between the dust housing and the first lever and configured to move the first lever toward the body; and a second lever elastic member positioned between the dust housing and the second lever and configured to move the second lever toward the body.

20. The cleaner of claim 18, further comprising a housing elastic member positioned on the body and configured to support the top of the dust housing.

* * * * *